United States Patent [19]

Holz, Sr. et al.

[11] 4,077,731

[45] Mar. 7, 1978

[54] REINFORCING WIRE LAYING MACHINES AND ATTACHMENTS

[75] Inventors: Orville H. Holz, Sr., Palm Harbor; Norbert J. Holz, Spring Hill, both of Fla.

[73] Assignee: Orville H. Holz, Jr., Roselle, Ill. ; a part interest

[21] Appl. No.: 550,364

[22] Filed: Feb. 18, 1975

[51] Int. Cl.[2] ..... E01C 19/00

[52] U.S. Cl. ..... 404/83; 180/19 R; 37/86; 172/42; 15/78; 299/39; 404/100

[58] Field of Search ..... 404/100; 242/86.5; 56/2; 140/107; 172/133, 256, 273, 276, 358, 42, 123

[56] References Cited

U.S. PATENT DOCUMENTS

| | | | |
|---|---|---|---|
| 1,174,803 | 3/1916 | Bathrick | 172/42 X |
| 1,546,107 | 7/1925 | Robb | 404/100 |
| 2,200,921 | 5/1940 | Granezl | 172/42 X |
| 2,613,582 | 10/1952 | Harshberger | 172/125 X |
| 2,684,495 | 7/1954 | Litkenhous | 172/42 X |
| 2,767,541 | 10/1956 | Yacoby | 172/42 X |
| 2,778,233 | 1/1957 | Perry | 172/42 X |
| 2,827,842 | 3/1958 | Peterson | 172/42 X |
| 3,015,364 | 1/1962 | Fitzgerald | 172/42 X |
| 3,632,054 | 1/1972 | Heppelman | 404/100 X |
| 3,814,144 | 6/1974 | Spencer | 404/100 X |

*Primary Examiner*—Nile C. Byers
*Attorney, Agent, or Firm*—Darbo & Vandenburgh

[57] ABSTRACT

A machine for laying reinforcing mesh for concrete comprises a pair of spaced front wheels and a pair of power driven rear wheels. Several different forms of devices are provided for lifting the roll of reinforcing mesh and positioning it between the front wheels. From that position the wire is unrolled from the top of the roll and passes back under the rear wheels, thereby back-bending the mesh as it is unrolled. In other embodiments not employing the front wheels, a pusher in front of the power driven wheels pushes the roll ahead of it along the ground as the latter wheels move along the mesh. In such embodiments hooks are provided on the pusher for engaging the roll in a manner such that, before unrolling, the roll may be lifted and transported to the desired location for unrolling. The safety hook is provided to the rear of the wheels to prevent the trailing edge of the non-backbended mesh from the roll from springing into the operator as the wheels move off that trailing edge.

In one of the embodiments, various types of mesh laying devices are attachments to a power head comprising a pair of wheels, a transaxle, a motor and handlebars. Various other power driven attachments useful to concrete contractors can be used on that power unit alternatively with the mesh laying device. Such alternative power driven tools include a saw for cutting the upper surface of a concrete slab or the like, a grinding head for grinding the upper surface of a concrete slab, an air compressor, a trencher, etc.

56 Claims, 29 Drawing Figures

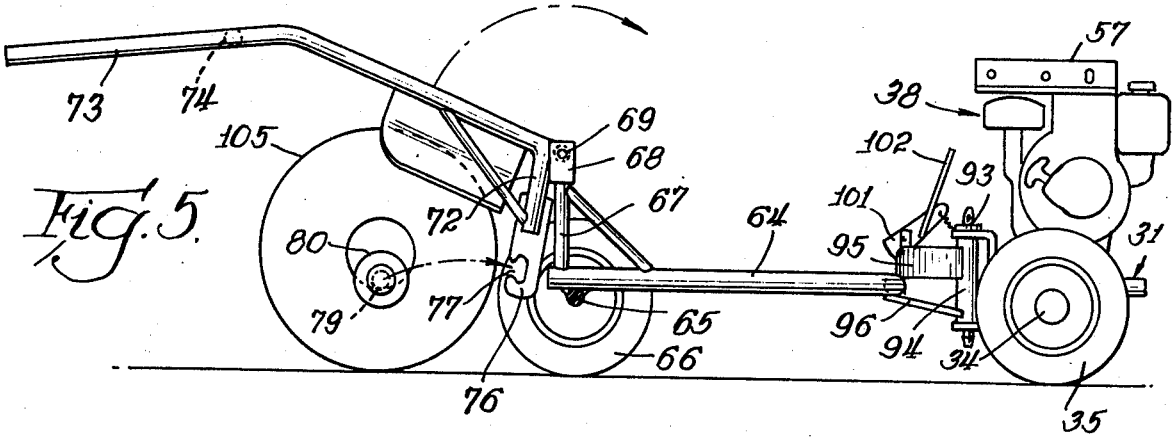
Fig. 5.
Fig. 4.
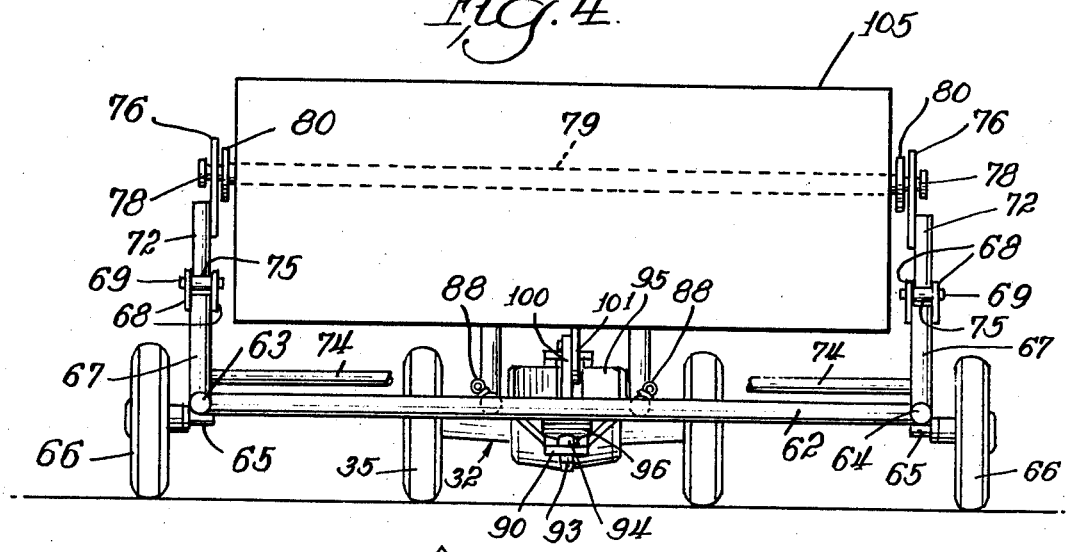
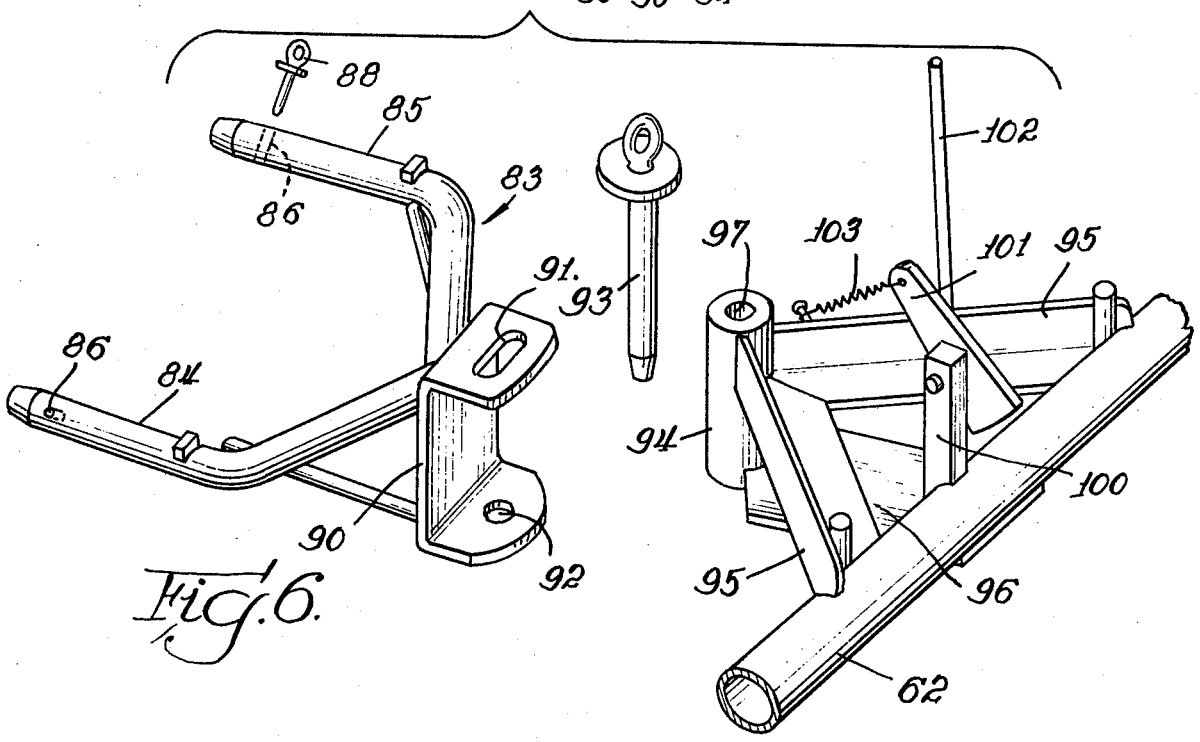
Fig. 6.

144
139
141
138
142
105
140
132
132
143
133a
133a
133
135
133
137
136
131
137

140
138
142
105
141
139
132
143
152
152a
35
133
133a
135
136
137
131

138
139
141
105
140
142
132
152
35
133a
152a
143
137
136
131
135

187
165
166
57
167
164
57b
38
42
186
193
163
162
188
185
58
195
160
161
184
194
54
192
153
183
151
181
176
182
180
55
34
156
172
173
158
157
155
150
35
171
174
175

187
183
176
185a
184
173
185
174
181
182
175
153
179
190
172
180
151
195
195
194
193
182
196
178
194
153
152
160a
173
153a
150
170
171
160
156
157
192
155
156
191
158

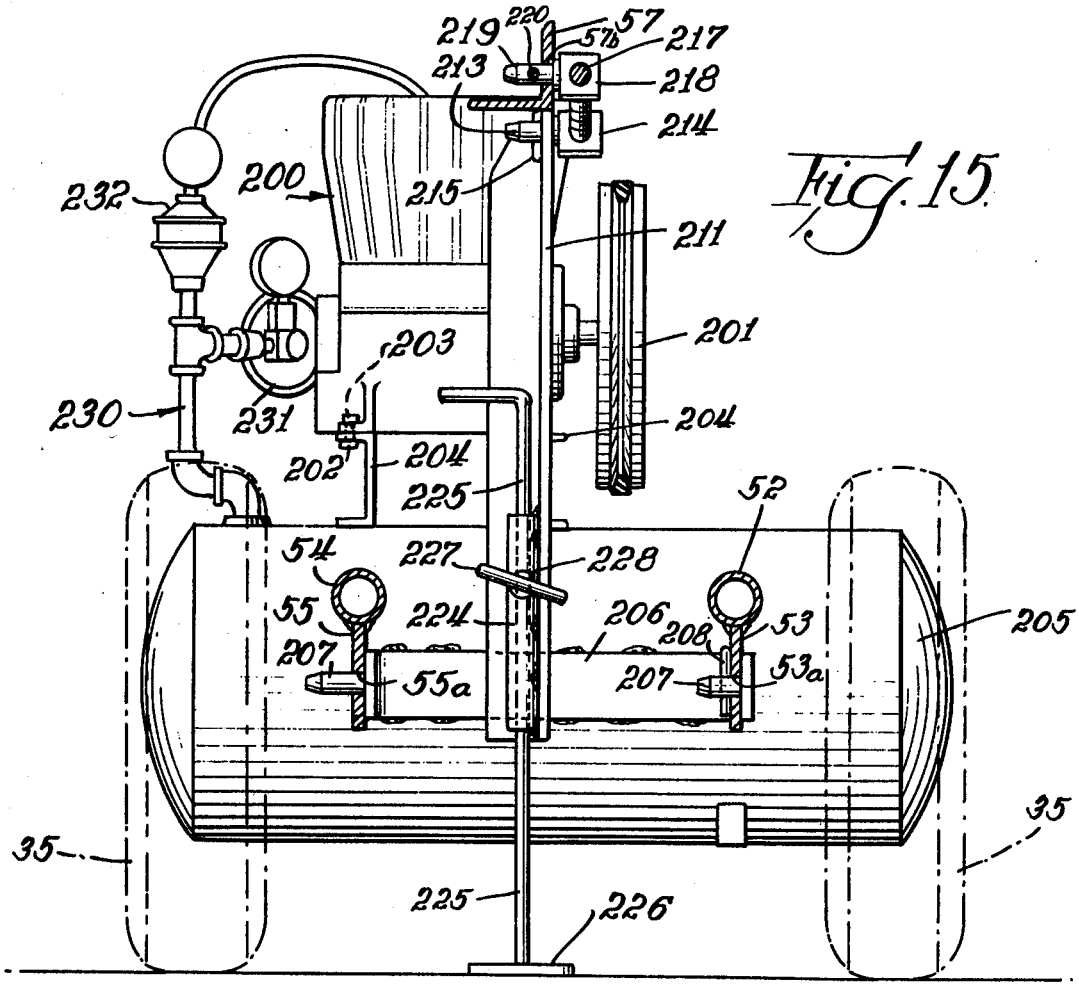
Fig. 15.
Fig. 16.
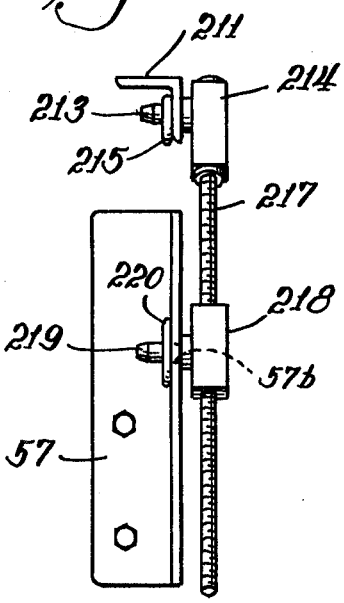
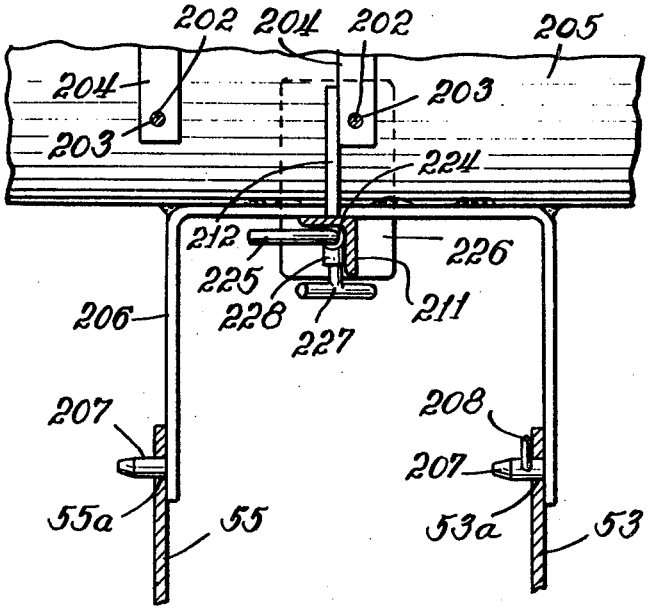
Fig. 17.

105
401
402
407
79
80
78
398
400
396
399
395
410
380
397
404
409
28
406
415
424
416
414
413
384
392
405
427
426
412
393
388
382
381
391
390
385
389
428
428a
383
422
419
420
421
418
423
387
411

REINFORCING WIRE LAYING MACHINES AND ATTACHMENTS

BACKGROUND AND SUMMARY OF THE INVENTION

A wire mesh reinforcing is normally employed in concrete flat work. This mesh is supplied in rolls. It is made up of wire of a relatively heavy gage, e.g. four to ten gage. The mesh comprises longitudinal wires to which are welded cross wires forming a plurality of rectangles of, for example, 6 inch (15.24 centimeters) squares. A roll normally will be 5 feet (1.52 meters) long (axial length) and contain 150 lineal feet (45.72 meters) of mesh when unrolled. Such a roll made of six gage wire will weigh in the neighborhood of three hundred pounds. The size and gage of the mesh commonly used may be different in different parts of the country.

From the foregoing description of a roll of reinforcing mesh it will be apparent that these rolls are heavy and awkward to handle. What is not so apparent is that substantial problems and dangers are involved in unrolling the mesh at the location at which it is to be used. The rolls are tightly wound at the factory. To some extent they react like a tightly coiled spring, in that the various turns will suddenly unwind to a limited extent as the mesh is being unwound from the roll. A common practice is to unroll the mesh by workmen pushing the roll along the ground or other surface. The workmen must be very careful not to allow their fingers to project into the mesh as this unrolling proceeds, because when the sudden release of some of the outer turns occurs (as in the case of the expanding clock spring) fingers projecting into the mesh will be trapped by the turns rotating with respect to each other. This will result in serious damage to the fingers, and even the severance of fingers. Use of the present invention eliminates this danger to workmen.

Another problem encountered in the use of wire mesh is that of getting the mesh to lay flat. As the mesh is removed from the roll, the longitudinal wires retain a residual curvature, in the direction in which they were bent to form the roll. This residual curvature results in the mesh not laying flat. To get it to lay reasonably flat, it is necessary that the mesh be "backbend", i.e., the longitudinal wires bent in the reverse direction sufficiently to remove the residual curvature. This is, of course, time consuming and thus adds to the expense of the construction job. Furthermore, unless the backbending operation is carefully performed it may introduce even more unevenness into the mesh thus increasing the difficulty in getting the mesh to lay flat. Embodiments of the present invention will automatically backbend the mesh as it is unwound from the roll.

Concrete contractors use numerous items of power tools. Practically all of these items can be purchased as individual units, each powered by its own gasoline engine, such as a concrete saw, a surface grinder for concrete, a trencher, etc. Such units are not cheap and a contractor can find himself with a very substantial monetary investment in this type of equipment. This can be particularly a problem for the smaller contractors who are faced with the question of whether the labor saving achieved by each of these various units is sufficient to offset the fact that each unit will not be in constant use, so that capital is tied up in the unit even though the unit is standing idle a great deal of the time. Some smaller contractors attempt to avoid the problem by renting such power equipment when it is needed. While this avoids having capital tied up in idle equipment, the rental charges are relatively high.

The present invention provides a plurality of attachments which are usable alternatively on one of a power unit employed in connection with the unrolling of wire mesh. Since each of these attachments can be purchased by the contractor without the necessity for its own internal combustion engine, etc., the contractor's investment therein is greatly reduced. Thus, he is able to afford such a piece of power equipment even though it may not be used every day. There is the further advantage that each unit which embodies its own internal combustion engine, etc., is comparatively heavy and awkward to handle as compared to an attachment which does not embody an internal combustion engine. Furthermore, an internal combustion engine that is used only infrequently may not be in operable condition when it is required on the job. When the power unit is run every day with one attachment or another, the contractor knows that the engine is in operating condition.

One of the attachments previously mentioned is a concrete saw for cutting through the surface of a concrete slab. When this attachment is used on the power unit, the resulting structure has a number of features that are advantageous as compared to comparable conventional equipment. The conventional equipment has the saw out in front of the operator and the rotation of the saw is such that the removed concrete (primarily dust) is thrown by the saw back towards the operator. In the embodiment of the present invention, the saw blade directs the removed material away from the operator. In addition, a guide is provided between the operator and the saw blade which enables the operator to accurately guide the saw along the line of cut. Furthermore, this guide arrangement is an aid to the operator in avoiding the undesirable situation of having the saw blade twisted in the kerf made by the saw.

Other objects and advantages will be apparent from the following description taken in conjunction with the drawings.

DESCRIPTION OF THE DRAWINGS

FIG. 4 is a front elevational view of the embodiment of FIG. 2;

FIG. 5 is a side view similar to FIG. 2 but illustrating the manner in which the roll of mesh is loaded onto the apparatus;

FIG. 6 is a fragmentary exploded view illustrating the hitch and related structure of the embodiment of FIG. 2;

FIG. 15 is a section as viewed at line 15—15 of FIG. 14;

FIG. 16 is a fragmentary plan view as seen at line 16—16 of FIG. 14;

FIG. 17 is a fragmentary view as seen at line 17—17 of FIG. 14;

DESCRIPTION OF SPECIFIC EMBODIMENTS

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

POWER UNIT FOR WALKING OPERATOR

Figure 1:
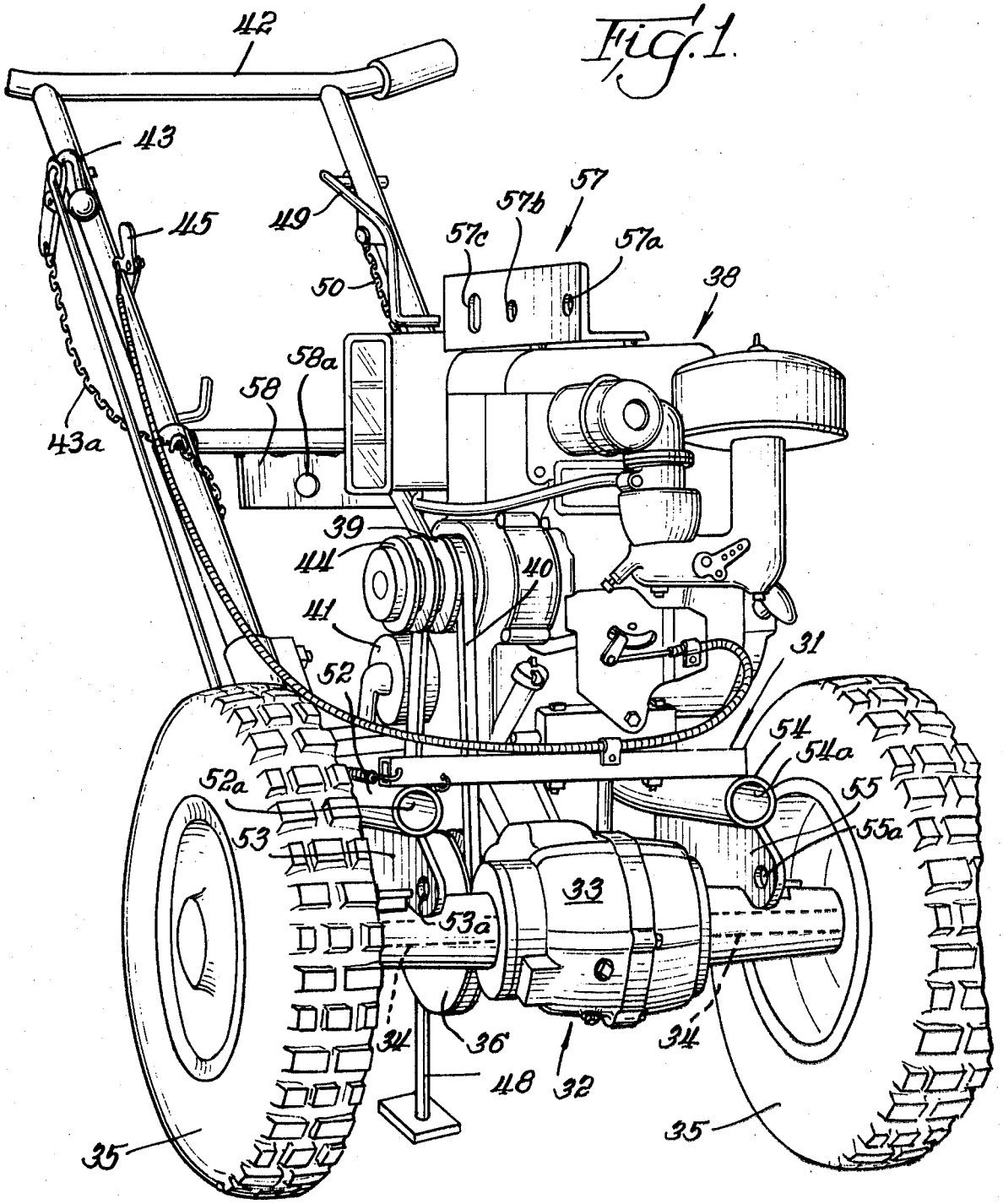
FIG. 1 is a perspective view of a power unit employed as a part of several types of reinforcing mesh unrolling devices and with other attachments usable by concrete contractors.

FIG. 1 illustrates a power unit with which a number of attachments are employed including several embodiments of reinforcing mesh laying devices. The power unit comprises a frame, generally 31, mounted on a transaxle, generally 32. A transaxle is conventional and will not be described in detail. It includes a housing 33 within which is a differential and various forward and reverse gears. Extending from the differential are shafts 34 on which wheels 35 are mounted. The power input to the transaxle is a pulley 36.

Power is supplied by an internal combustion engine, generally 38. In the illustrated embodiment this engine is a gasoline engine. The output shaft of the engine has a pulley 39 which drives pulley 36 through a belt 40. A movable takeup pulley 41 contacts belt 40 to serve as a clutch. Mounted on the handlebar 42 of frame 31 is a clutch control lever 43. When this lever is moved to a rearward position (as in FIG. 7) the take-up pulley 41 is pressing against belt 40 so that the transaxle is being driven from the motor. With the control lever forwardly (as in FIG. 1) the pulley 41 is not pressing significantly against belt 40 so that the belt is loose and thus is no longer effective to drive pulley 36. Chain 43*a* is a safety clutch disengaging device equivalent to rod 128, FIG. 7. The output shaft of motor 38 has a pair of second pulleys 44 which serve as a power take-off drive for power driven attachments. A throttle 45 is positioned on handlebar 42 and serves to operate the carburetor of engine 38.

Figure 20:
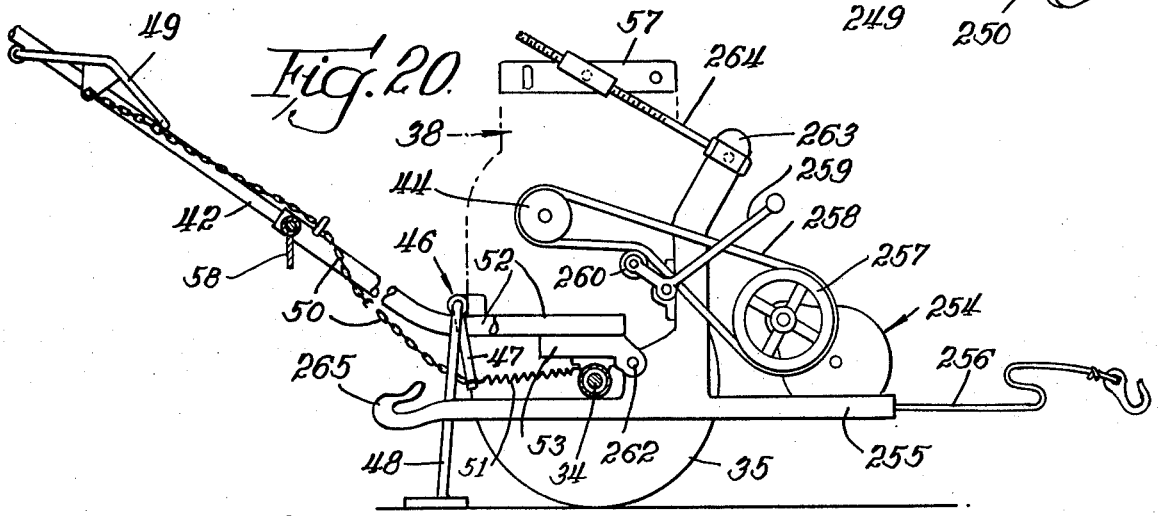
FIG. 20 is a side view of a winch attachment mounted on the power unit of FIG. 1.

A "U" shaped member, generally 46, has two legs 47 and 48 (see FIG. 20). Member 46 is pivotally mounted on the frame. Leg 48 forms a foot. A lever 49 is pivotally mounted on handlebar 42 and is connected by a chain 50 to foot 48. A spring 51 connects leg 47 and frame 31. In one position of lever 49 the chain is slack allowing foot 48 to descend to the vertical position (being pulled by chain 51) and bear against the ground. The frame forms a stop (not shown) to limit the forward movement of leg 47. In a second position of lever 49, the chain holds foot 48 upward well clear of the ground. It should be noted that the engine 33 is on the handlebar side of the shafts 34 so that the weight of the engine tends to rotate the frame 31 about the axis of the shafts 34 (in a clockwise direction as viewed in FIG. 2). Thus, with the foot down, that force is applied against foot 48 and in turn the force is resisted by the pressure of the ground on the foot. Thus, the power unit is stable with the foot 48 resting on the ground.

The frame includes two main hitches and two supplemental hitches. The main hitches consist of spaced sockets which provide a rigid connection to the power unit and spaced journals which provide a pivotal connection. Thus, at the side of the frame opposite to that of handlebar 42 are a tube 52 which defines a socket 52*a*, a plate 53 having an opening 53*a* therethrough, a tube 54 defining a socket 54*a* and a plate 55 having an opening 55*a* therein. Openings 53*a* and 55*a* are on a common axis parallel to shafts 34. Plates 53 and 55, at the openings therein, form the aforesaid journals to receive pivot pins subsequently to be described. The axes of sockets 52*a* and 54*a* are at right angles to the axis of these journals and to the axis of shafts 34, i.e., the sockets are positioned in front to back alignment.

Referring to the supplemental hitches: an angle 57 is secured to the top of engine 38 which forms a part of frame 31; i.e., in the sense of holding this angle 57 in that position, the engine 38 forms a part of the frame 31. Angle 57 has three openings 57*a*, 57*b* and 57*c* therein. The principal function of this angle is to hold belt tighteners for the various attachments as hereinafter described. A plate 58 having an opening 58*a* is secured to handlebar 42. This plate provides a mount for an attachment positioning device for the concrete saw, as subsequently described herein.

REINFORCING MESH LAYING ATTACHMENT OF FIGS. 2–6

The attachment illustrated in these Figures includes a "U" shaped frame comprising a cross member 62 and two side members 63 and 64. At the distal ends of the side members are stub axles 65 on which ground engaging wheels 66 are rotatably mounted. Posts 67 extend upwardly from the distal ends of the side members. Each post has a pair of plates 68 welded to the sides thereof. These plates have aligned openings to receive pivot pin 69. At each side an "L" shaped member is pivotally mounted on the respective pin 69. Each "L" shaped member includes a lifting arm 72 and an operating arm 73. The two operating arms are connected by a crossbar 74. At about the juncture of the two arms a tube 75 is welded to the "L" shaped member to receive pivot pin 69. The distal ends of arms 72 are formed by plates 76, which plates have an opening 77 therein whereby the plates define sockets. These openings are of a size to receive only the small end sections 78 of a trunnion or shaft 79. At the inner ends of small sections 78 are enlarged guide plates 80 forming a part of shaft 79.

The hitch device is best seen in FIG. 6. It includes a yoke, generally 83, which forms a pair of shafts 84 and 85. Shaft 84 is received in socket **52*a* and shaft 85 is received in socket 54*a*. The shafts have openings 86 which, when the shafts are properly positioned in the sockets, are aligned with openings 87 in tubes 52 and 54. Pins 88 are inserted through the aligned openings to hold the shafts in the sockets. Yoke 83 includes a coupling member 90 having vertically spaced openings 91 and 92 therein. These openings are somewhat larger than hitch pin 93. Opening 91 particularly is large in the transverse direction. Cross member 62 has a sleeve 94 secured thereto by angles 95 and plate 96. Sleeve 94 has a vertically aligned axial opening 97 to pivotally receive pin 93. Thus the hitch pin 93, coupling member 90 and sleeve 94 form a universal joint having limited movement; that is, the sleeve 94 can pivot with respect to the pin about a vertical axis and the pin can rock back and forth in openings 91, 92** about a horizontal, front-to-back axis.

Extending upwardly from crossbar 62 is a fixed post 100. A lever 101 is pivotally mounted adjacent the top of the post and forms a latch for crossbar 74. A handle 102 is welded to lever 101. A spring 103 connects lever 101 and one of the angles 95.

Figure 2:
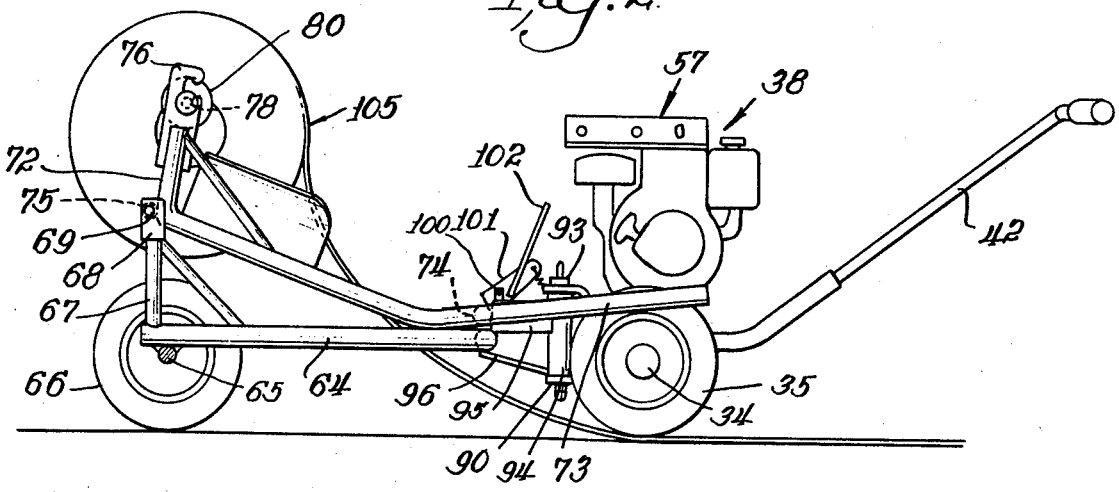
FIG. 2 is a side elevation of the power unit of FIG. 1 with a reinforcing mesh unrolling attachment.
Figure 3:
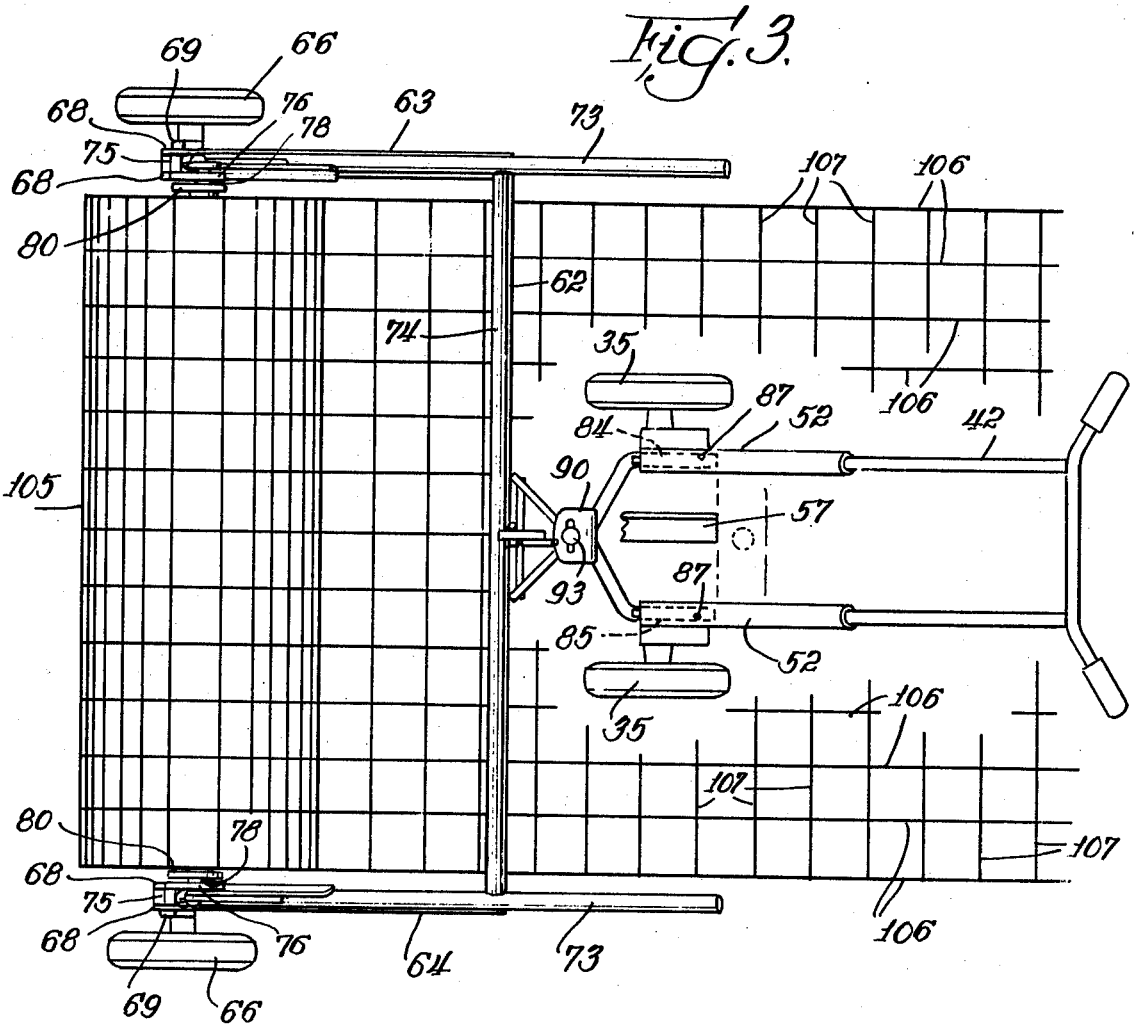
FIG. 3 is a plan view of the embodiment of FIG. 2.

This attachment is, of course, for the purpose of unrolling a roll 105 of concrete reinforcing mesh. Such mesh comprises a plurality of longitudinal wires 106 having transverse wires 107 welded thereto at spaced intervals. With the roll 105 resting on the ground or other supporting surface, the trunnion or shaft 79 is inserted therethrough as illustrated in FIG. 5. With the lifting arm 72 extending downwardly, the apparatus is moved up to the roll of wire and the small end sections 78 of the trunnion are inserted into openings 77 in the lifting arm. One or two persons then grasp the operating arms 73 and rotate them about pins 69 in a clockwise direction as viewed in FIG. 5. At the completion of that rotation, the operating arms 73 are in a generally horizontal position and the lifting arms 72 are generally vertical as seen in FIGS. 2, 3 and 4. The crossbar 74 slips under latch 101, which latch then holds the crossbar and arms in that position. The mesh is now ready to be unrolled from roll 105.

As best seen in FIG. 2, it will be noted that roll 105 was positioned on the trunnion 79 so that the outer edge of the mesh (the leading edge as the roll is unrolled) would be facing to the rear when at the top of the roll. This is important. If it were facing forwardly when at the top of the roll there would be no backbending of the mesh.

This outer end of the mesh is now drawn down manually and inserted under the front of wheels 35. From FIGS. 3 and 4 it will be seen that the wheels are closer together than the width of the mesh (i.e., the axial length of the roll); thus the power unit may now be driven forwardly (to the left in FIGS. 2 and 3) across the top of the mesh. This causes the mesh to be withdrawn from roll 105 and laid flat on the ground or other supporting surface. In the course of doing this, the mesh is bent in the reverse of the direction that the longitudinal wires 106 were bent when coiled on the roll 105, as best seen in FIG. 2. This results in a significant straightening of the mesh, i.e., a straightening of the longitudinal wires 106. The result is that the mesh will lay substantially flatter than would be the case were that backbending not to be effected, i.e., were the roll 105 to be placed upon the trunnion 79 in the reverse orientation previously mentioned.

REINFORCING MESH LAYER OF FIGS. 7–8

Figure 14:
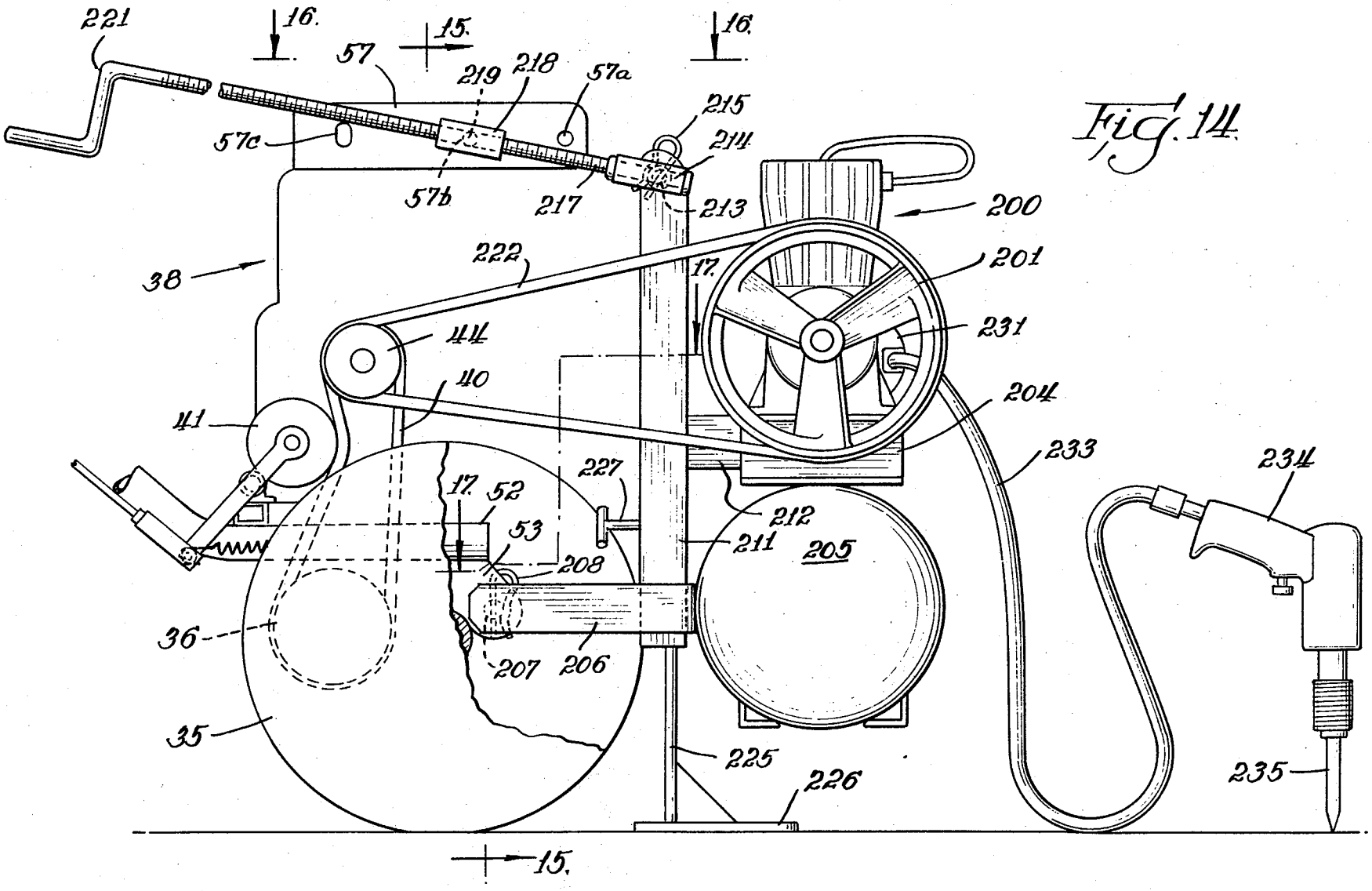
FIG. 14 is a side elevational view of an air compressor attachment mounted on the power unit of FIG. 1.

This embodiment comprises a pusher bar 110 which is immediately adjacent the ground. It is parallel to the axis of shafts 34. Extending from the rear of the pusher bar are skids 111. Extending forwardly from each end of the pusher bar is a guide plate 112 for the roll of mesh 105. The guide plates 112 are spaced apart a distance slightly greater than the axial length of the roll. Extending rearwardly and upwardly from the pusher bar are a pair of upright members 113. A connecting plate 114 extends across the top of the upright members and is welded thereto. This connecting plate has a wing 115 welded thereto. The assemblage includes a pair of connecting arms 116. These connecting arms have pins 117 on the ends thereof. These pins ae received in openings **53*a* and 55*a* of the power unit. After being so mounted, cotter keys or spring clips (such as 208 in FIG. 14) are inserted through openings 117*a* in pins 117** to hold the pins in place.

A threaded rod 120 has one end rotatably mounted in a block 121, but held in the block against longitudinal movement. The block is secured to wing 115 for movement about a horizontal axis. An internally threaded nut 122 on threaded rod 120 has a pin 123 extending therefrom. Pin 123 is inserted into opening **57*a* in angle bracket 57. The cotter key or spring clip is then inserted through opening 123*a* on the other side of the angle iron from nut 122 to hold the pin in place. By turning threaded rod 120, block 121 can be moved toward or away from engine 38 thus suitably positioning the uprights 113** of the wire pusher.

Figure 7:
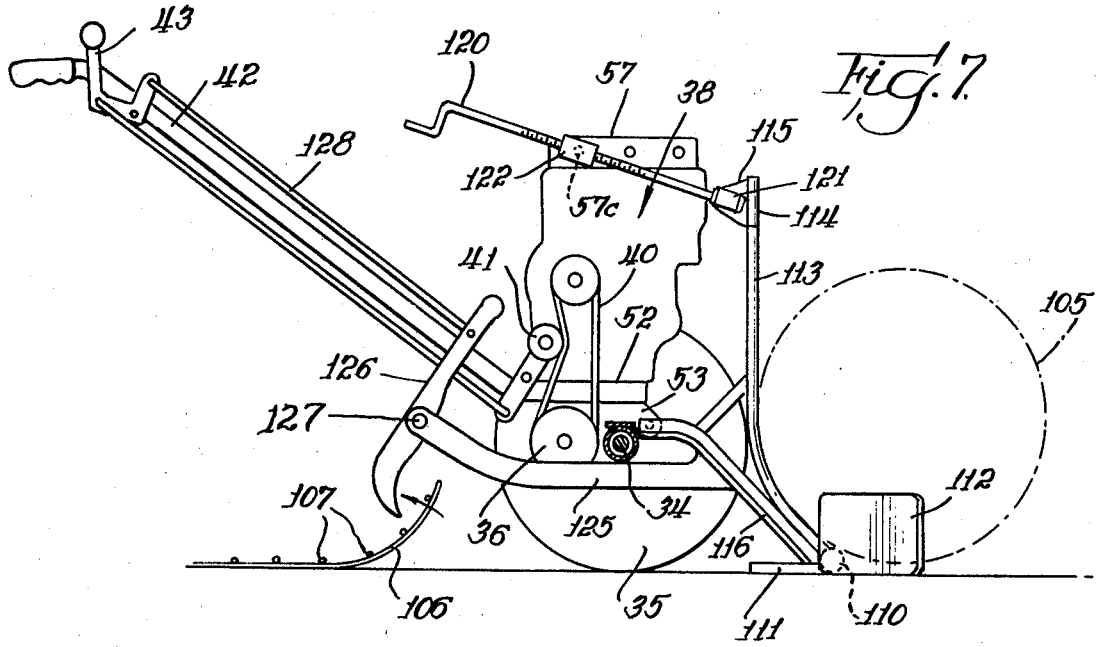
FIG. 7 is a side elevational view of another embodiment of wire laying apparatus incorporating the power unit of FIG. 1.
Figure 8:
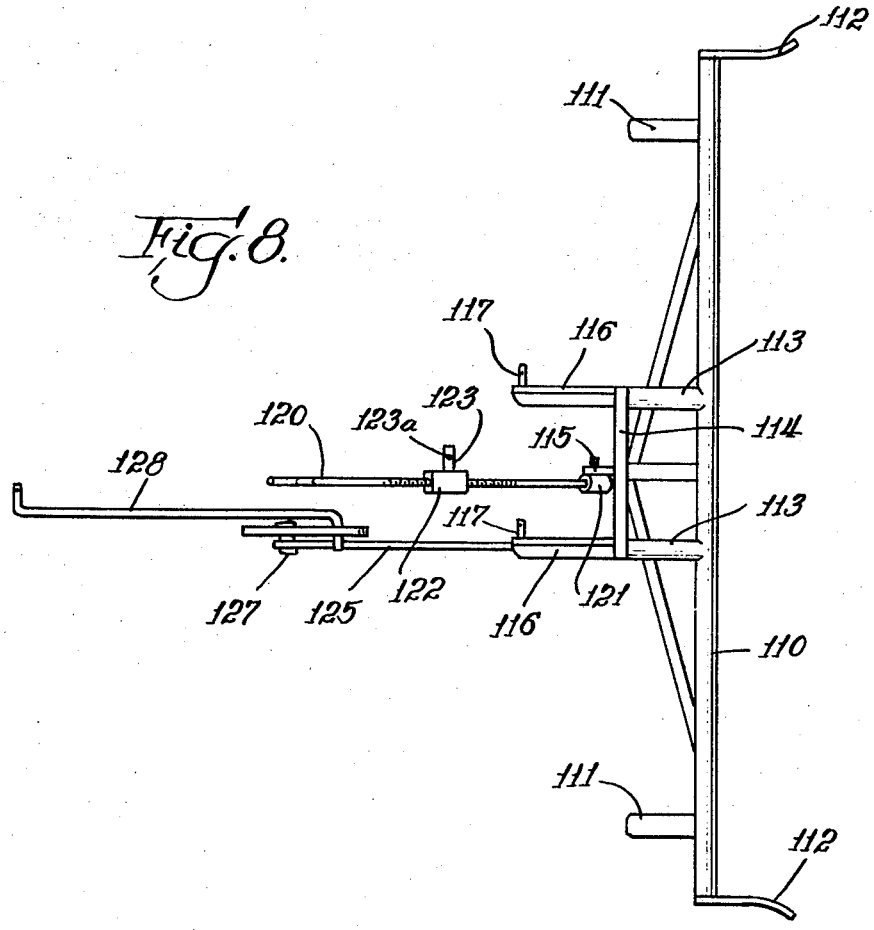
FIG. 8 is a plan view of the wire laying attachment of FIG. 7 apart from the power unit.

An arm 125 is a rigid part of the attachment framework. On the distal end of the arm a lever 126 is pivotally mounted on a pin 127. The lower end of the lever forms a forwardly facing hook. A connecting rod 128 connects the upper end of the lever 126 to the clutch lever 43. The arrangement is such that when a clutch, including pulley 41, is engaged so that the transmission is being driven, the lever 126 is positioned, as illustrated in FIG. 7, with the hook facing generally forwardly. When the clutch is disengaged so that power is not being supplied to the transmission, lever 126 is in a substantially horizontal position with the lower hook end turned clockwise from the position illustrated in FIG. 7. Thus, the clutch can be disengaged as a safety measure by the application force to the hook, as indicated by the arrow, as by hooking the mesh while the machine is moving as is further described below.

To use this attachment in unrolling mesh, the roll of mesh is placed in front of the pusher bar 110 and its uprights 113 as seen in FIG. 7. The outer edge of the mesh faces rearwardly at the bottom of the roll. This edge is placed under pusher bar 110 so that as the apparatus moves forwardly (i.e., to the right in FIG. 7) the mesh moves under the pusher bar and under wheels 35. As the apparatus is driven forwardly it pushes the roll of mesh 105 ahead of it and the mesh is laid out of the rear of the apparatus.

The lever 126 is for protection of the operator when a roll is completely unwound. As previously described, at that time the longitudinal wires have considerable residual curvature and act much like a coiled spring. As the wheels 35 move off the end of the mesh which was at the inside of the roll that portion of the mesh wants to spring up in a semicoil. This occurs with considerable force. It is possible that an individual walking behind the apparatus while guiding it with handlebars 42 could be hurt by the end of the mesh. As illustrated in FIG. 7, the end of the mesh as it springs up will catch the lower hook end of lever 126. This force will act to rotate the lever in a clockwise direction, disengaging the clutch so that the power unit will stop with the end of the mesh held by the hook for manual disposition.

When a roll is being unrolled, it is guided by the operator moving handlebar 42. The pusher bar 110 along with guide plates 112 enable the operator to position the roll in the proper alignment for laying the mesh in the desired location.

REINFORCING MESH CARRIER AND UNROLLER OF FIGS. 9–11

This embodiment includes a pusher bar 131 at ground level. Two upright members 132 extend rearwardly and upwardly from the pusher bar. Also extending rearwardly from the pusher bar are a pair of shafts 133, the distal ends of which are received in the sockets **52*a* and 54*a* of the power unit. Pins 88 are inserted through the sockets and openings 133*a*** to lock the shafts in the sockets.

A sleeve 135 is welded to shafts 133 above and to the rear of the center of the pusher bar 131. A rod 136 having hooks 137 at the two distal ends is journaled in sleeve 135. A rod 138 forming a shaft is welded to the top of uprights 132. Journaled on this rod is a sleeve 139. Two lugs 140 and 141 are welded to sleeve 139. Lug 140 forms a handle. A rod 142 has one end pivotable in an opening in lug 141 and the other end forms a hook 143.

Figure 9:
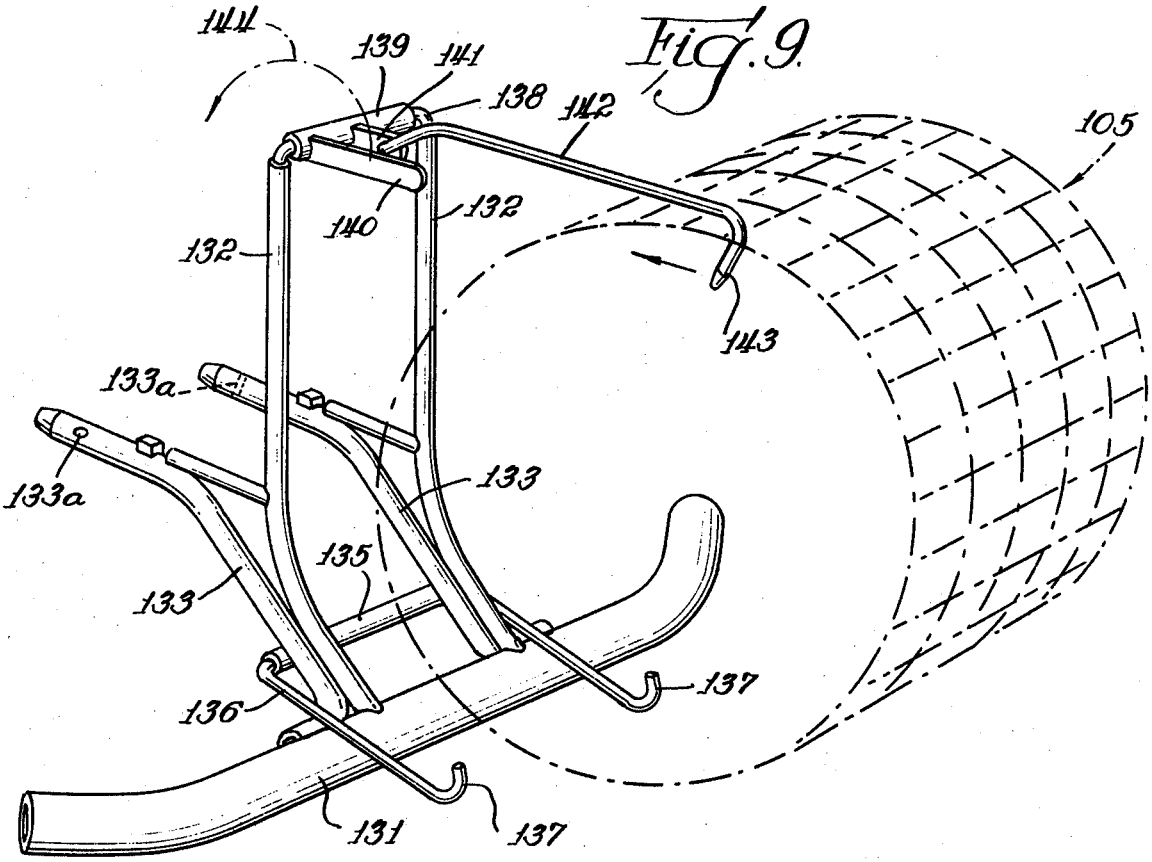
FIG. 9 is a perspective view of another form of wire laying attachment used with the power unit of FIG. 1 and showing the manner of engagement of the roll of mesh and the attachment for the purpose of transporting the roll.

This attachment may be used for transporting a roll of mesh 105 as well as for unrolling the roll. To transport the roll the rod 136 is laid down across the top of pusher bar 131 in the manner illustrated in FIGS. 9 and 10. The roll 105 is then moved up on top of hook 137 and against the upright members 132. With the lug 140 projecting forwardly as illustrated in FIG. 9, the hook 143 is brought into engagement with the mesh at the top of the roll. The operator then raises and pulls back on lug 140 as illustrated by line 144, thus rotating the sleeve 139 to the position illustrated in FIG. 10. The across-the-center movement of lug 141 and rod 142 as sleeve 139 is thus rotated, draws hook 143 back to lock the roll 105 securely against the uprights 132 and pusher bar 131. The operator now can push down on handlebar 42 of the power unit which will cause the attachment to move upwardly. Thus, the roll of mesh 105 is now supported on the front of the attachment. The assembly is then driven to the desired location for roll 105.

Figure 10:
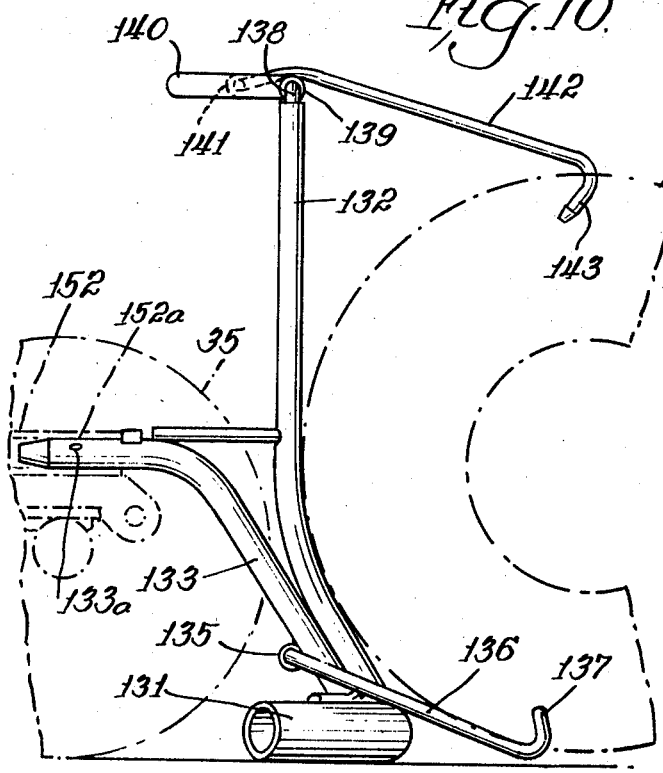
FIG. 10 is a side elevational view of the attachment of FIG. 9 when used for transporting the roll of reinforcing mesh.

When the mesh of the roll 105 is to be laid, sleeve 139 is rotated clockwise from the FIG. 10 position to the position illustrated in FIG. 9. Hook 143 may now be withdrawn from the mesh. The roll of mesh is moved off of hooks 137. Rod 136 is rotated counterclockwise from the FIG. 10 to the FIG. 11 position. Rod 142 is permitted to drop to the position illustrated in FIG. 11. The outer edge of the mesh is moved under pusher bar 131 and under wheels 35. The apparatus then is driven forwardly (to the right of FIG. 11). This causes the roll 105 to unroll ahead of the apparatus as the apparatus moves across the top of the mesh.

CONCRETE SAW ATTACHMENT OF FIGS. 12–13

The attachment frame of the concrete saw comprises a channel 150 having arms 151 and 152 extending upwardly from the rearward end of the channel. At the upper end of the arms are pins 153 which are received in openings **53*a* and 55*a* of the power unit. A cotter key or spring clip is then inserted through openings 153*a* to hold the pins in place on plates 53 and 55. On the under side of the channel adjacent the opposite end is a mandrel formed by shaft 155 in bearings 156. The shaft is rotatable in the bearings but restrained against axial movement. A concrete saw blade 157 is secured to one end of shaft 155. The shaft has drive pulleys 158** attached to its other end.

An upright 160 welded to the channel has an opening **160*a* adjacent its upper end. The pin 161 of the block 162 projects through opening 160*a*. A spring clip 163 is inserted through an opening in pin 161 to hold the pin in place. A threaded rod 164 is journaled in block 162; however, the block retains the rod against longitudinal movement away from the block. A nut 165 is threaded on rod 164. Nut 165 has a pin 166 which extends through opening 57*b* in angle 57. The end of rod 164 forms a crank 167** for rotating the rod.

A sleeve 170 is welded to the under side of channel 150. A rod 171 is journaled in sleeve 170 and has two ends which are welded to a shaft 172. Wheels 173 are rotatably mounted on shaft 172. The boss 174 of a guide pointer 175 is received on shaft 172. A locking screw 176 is threaded through boss 174 and frictionally engages shaft 172.

A sleeve 178 is journaled on shaft 172. A plate 179 is welded to a sleeve 178 and to a bushing 180. A rod 181 is rotatably mounted in bushing 180. It has enlargements 182 secured thereto at each end of the bushing so as to prevent longitudinal movement of the rod in the bushing. The rod is threaded at 183 to receive nut 184. A pin 185 forming a part of nut 184 projects through opening **58*a* in plate 58 on the power unit. It is held in place by a cotter key or spring clip 186 which extends through opening 185*a* in pin 185. The upper end of rod 181 forms a crank 187. Belts 188 connect engine pulley 44 and mandrel pulleys 158**.

Guide pointer 175 is positioned longitudinally on shaft 172 so as to be in line with saw blade 157 when the power unit is moved straight. Crank 167 is rotated to supply the proper tension to belts 188. Rotating the crank lengthens or shortens the distance between pins 161 and 166, which causes a pivotal movement of pins 153 in openings 53*a* and 55*a*. The depth of the saw cut is adjusted by rotating crank 187. This raises or lowers the wheels 173 which causes the frame of the power unit to pivot about axles 34. Thus moving the wheels 173 upwardly toward plate 58 has the effect of raising the saw blade 157 with respect to the ground. Conversely, moving wheels 173 away from plate 58 has the effect of lowering the saw blade 157 with respect to the ground and thus increasing the depth of cut.

Figure 12:
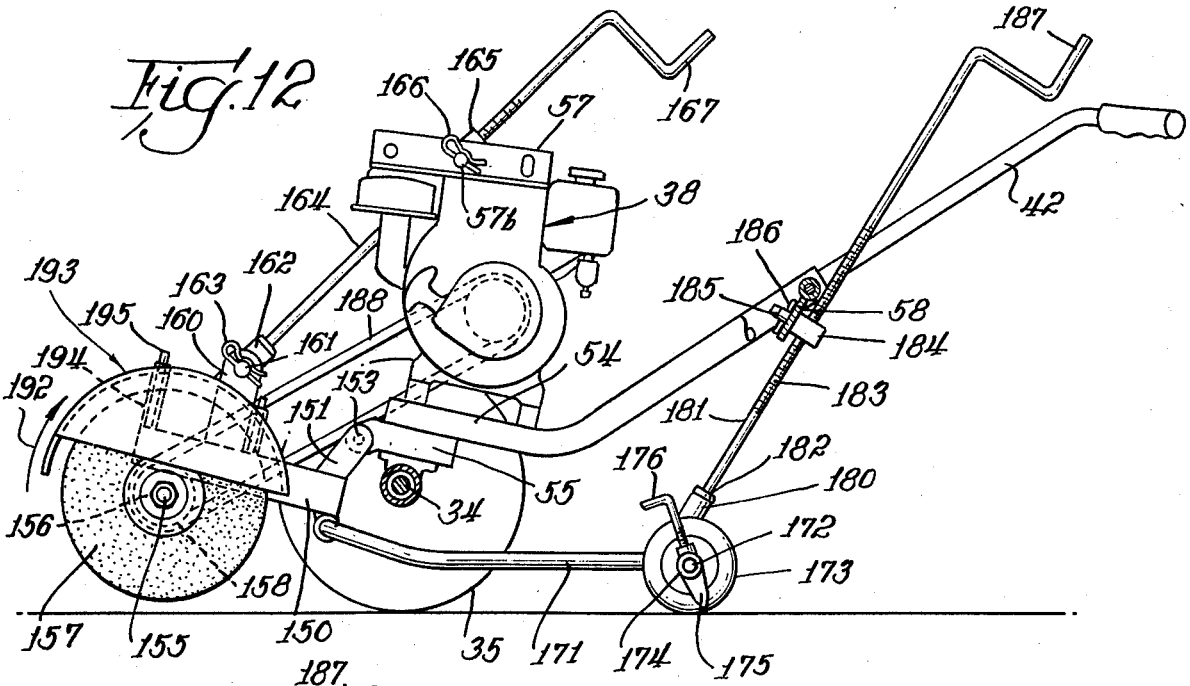
FIG. 12 is a side elevational view of a concrete saw attachment mounted on the power unit of FIG. 1.

A line 190 is made on the surface of the concrete slab to be cut. With the saw blade 157 on that line and rotating, the crank 187 is turned until the saw blade 157 enters the concrete to the desired depth cut. The operator then moves backward while holding handlebar 42, with the machine moving with him (to the right in FIG. 12). The operator maintains pointer 175 on line 190. This insures that saw blade 157 will continue along the desired line of cut. Due to the substantial spacing between the saw blade and the pointer it is possible to maintain a high accuracy in the alignment of the cut. Furthermore, there is little likelihood of the saw blade twisting and binding in the kerf 191 left by the saw blade.

The saw blade rotates in a direction indicated by arrow 192. Thus the material removed by the saw blade from the slab being cut is thrown away from the operator rather than towards him as is the case with most other commerically available machines. The saw blade has, of course, a guard 193 about it. This guard has sleeves 194 welded thereto. The sleeves are slipped over vertical pins 195 welded to channel 150. Thus, it is easily removed when the saw blade 157 is to be changed. One of the pins has a cotter key 196 therethrough to prevent accidental displacement of the guard.

Figure 13:
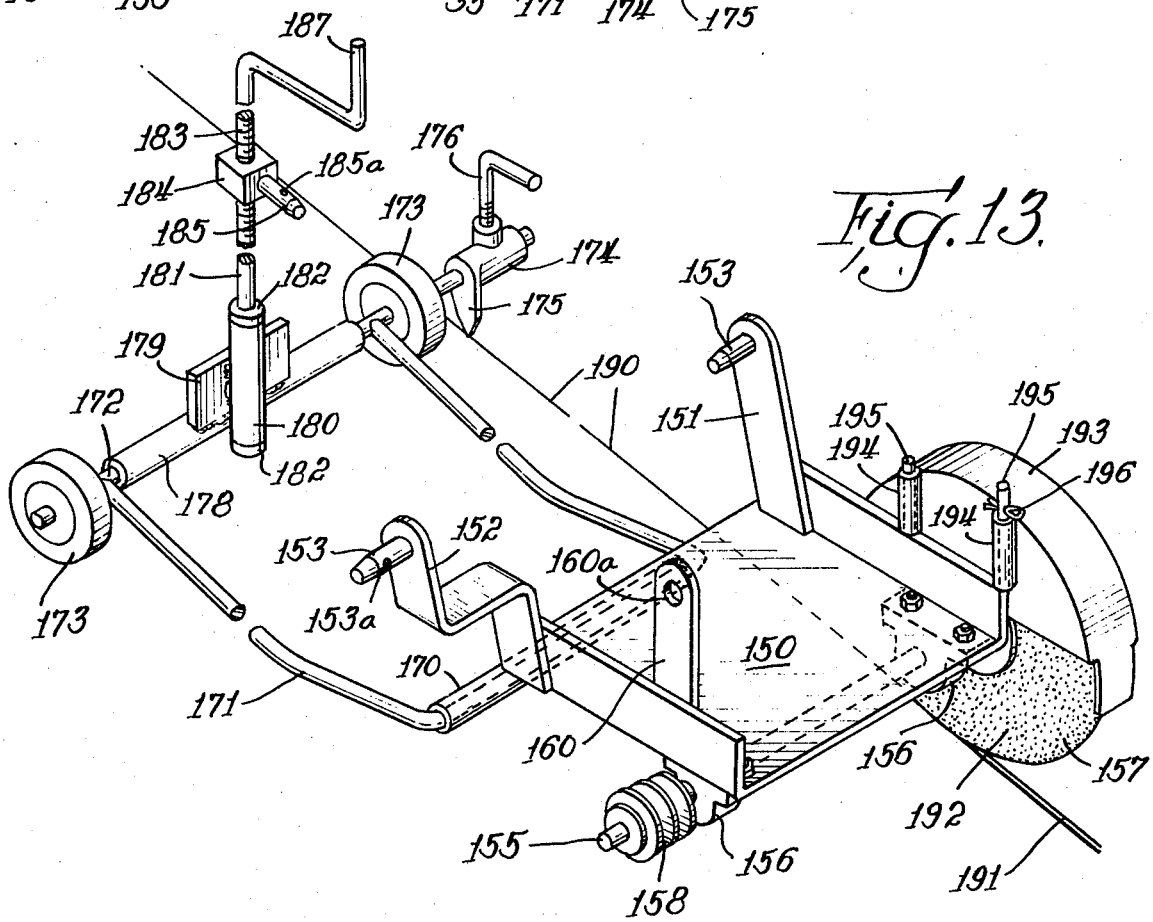
FIG. 13 is a perspective view of the attachment of FIG. 12 apart from the power unit.

A significant feature of this attachment is its ready portability. After it has been detached from the power unit, the handle 187 and rod 181 may be tipped back across channel 150. This is, of course, done by rotating sleeve 178 on shaft 172. The attachment is then easily carried by one man since it is relatively light and quite compact. Alternatively, by repositioning pointer 175 and inverting the folded assembly, a person can grasp handle 187 (which then extends beyond channel 150 to the right in FIG. 13) and roll the attachment along the ground on wheels 173.

AIR COMPRESSOR ATTACHMENT OF FIGS. 14–17

This attachment employs a piston type air compressor, generally 200, having a drive pulley or input wheel 201. Bolts 202 through the base of the air compressor and through holes 203 in channels 204 secure the air compressor to those channels. The channels are welded on the top of an air supply tank 205. A "U" shaped bracket 206 is welded to the side of the air tank. This bracket has pins 207 which extend through holes 53*a* and 55*a* on the power unit. At least one of these pins has an opening to receive a spring clip 208.

An angle 211 is welded to "U" bracket 206 and extends upwardly therefrom. A tie brace 212 is also welded to angle 211 and to one of channels 204. At its upper end, angle 211 has an opening to receive pin 213 of a retaining block 214. A spring clip 215 extends through an opening in pin 213. A threaded rod 217 is rotatably mounted in block 214, but restrained against longitudinal movement. A nut 218 is threadably received on rod 217. Nut 218 has a pin 219 which projects through opening 57*b* in angle 57. A spring clip 220 holds the pin in place by being inserted through an opening in the pin. Rod 217 has a crank 221 on the end thereof. By rotating the crank the belt 222 between pulleys 44 and 201 may be loosened or tightened.

A sleeve 224 is welded to angle 211. Extending through the sleeve is a rod 225 having a foot 226 on its bottom end. A locking screw 227 is threaded through a boss 228 on sleeve 224. By loosening screw 227 the rod 225 may be adjusted vertically to suitably position foot 226. Retightening screw 227 then holds rod 225 in the established position.

Air connections (piping, etc.), generally 230, provide communication between compressor 200, tank 205, pressure regulating valve 231 and excess pressure relief valve 232. A connection on regulating valve 231 provides a place for coupling a hose 233 to supply air as required. For the purpose of illustration, hose 233 is connected to an air hammer 234 to actuate a chisel 235.

ATTACHMENTS OF FIGS. 18–24

Figure 18:
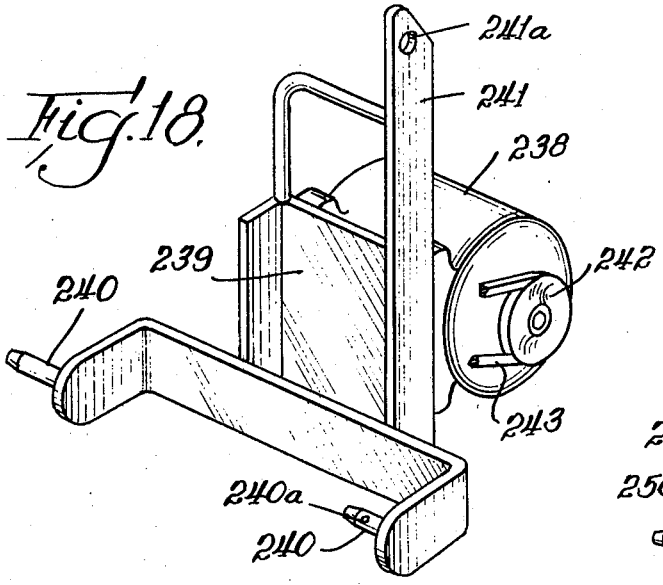
FIG. 18 is an electric generator attachment for the power unit of FIG. 1.

FIG. 18 illustrates a 110 volt A.C. generator 238 mounted on a frame 239. The frame has a pair of axially aligned pins 240 positioned to be received in openings 53*a* and 55*a* on the power unit. Pin 240 has an opening 240*a* to receive a cotter key or spring clip as a retainer. The frame includes an upstanding arm 241 having an opening 241*a* therein to receive a belt tightener of the type described in connection with other attachments. The generator has a drive pulley or input wheel 242. A belt 243 drives pulley 242 from the engine pulley 44.

In many construction jobs the concrete contractor will not have electric power available. Yet it is important that he have electric power to operate such power tools as electric saws which he will use to cut lumber for concrete forms and the like. When such a situation occurs the attachment of FIG. 18 can be hung on the power unit of FIG. 1, which undoubtedly will be on the job for other purposes in any event, and can plug his electric saws, etc., into generator 238 to be powered thereby.

Figure 19:
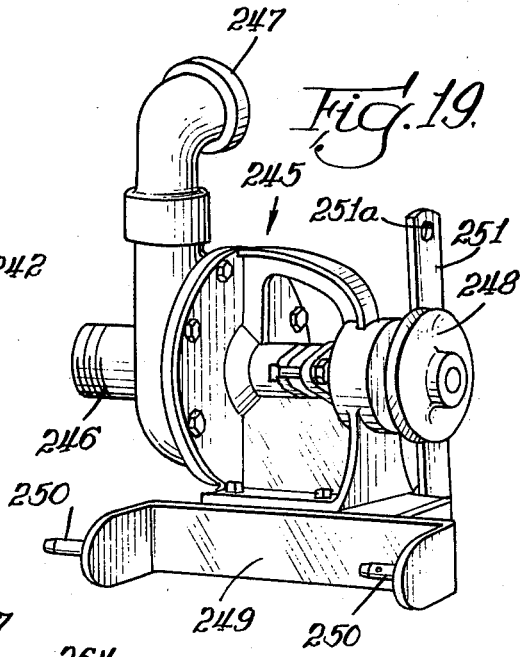
FIG. 19 is a water pump attachment for the power unit of FIG. 1.

FIG. 19 illustrates a water pump, generally 245. This pump includes an intake coupling 246 for a hose or the like and a discharge coupling 247. The pump is driven by a pulley or input wheel 248 on the pump shaft. The pump is mounted on a frame 249 which has a pair of pins 250 receivable in openings 53*a* and 55*a* on the power unit. The frame also includes a fixed arm 251 having an opening 251*a* to receive the belt tightener. Pulley 248 is driven by a belt, not shown in FIG. 19, from power unit pulley 44 in the manner previously described.

Again, a pump is often required by a concrete contractor, but certainly not on every job. For example, the contractor may be required to pour concrete in an excavation in which water is accumulating. He must be prepared to remove the water from that excavation while the forms are being placed and the concrete poured. Having the power unit of FIG. 1 on the job, it is a simple matter for the contractor to bring the pump of FIG. 19 to the job and hang it on the power unit. Since the contractor may not need a pump all the time and for every job, he need not have a lot of money tied up in a self-powered unit which in addition to its cost is large and clumsy as compared to the FIG. 19 attachment.

FIG. 20 illustrates a winch attachment comprising a winch, generally 254, mounted on a frame 255. The winch includes a drum (not shown) on which a cable 256 is wound. The drum is driven by internal gearing (not shown) from a pulley or input wheel 257. Pulley 257 is driven by a belt 258 from pulley 44 on the engine 38. A lever 259 is pivotally mounted on the attachment frame 255. One end of this lever serves as a handle and the other end carries an idler pulley 260, engaging belt 258 and serving as a clutch. FIG. 20 shows the clutch engaged. When pulley 260 is moved away from belt 258 the belt is loose and no longer serves to drive winch pulley 257.

Frame 255 includes a pair of pins 262 which are axially aligned and received in openings 53*a* and 55*a* of the power unit. The frame includes an upwardly extending arm 263 having an opening therein to receive belt tightener 264 of the type previously described (corresponding to that illustrated in FIG. 14 and connected to angle 211). The frame includes a hook 265. This permits the frame to be connected by a chain, cable, etc. to an immovable object. Thus when cable 256 is wound onto the winch 254 that pulling force will be transmitted to the immovable object.

Figure 21:
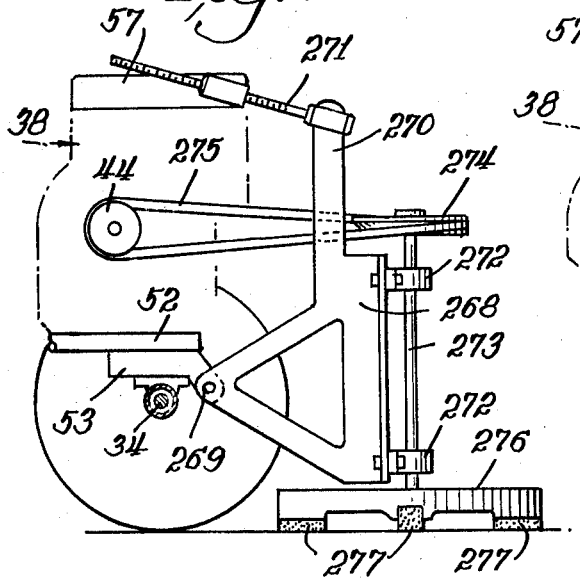
FIG. 21 is an elevational view of a surface grinder attachment for the power unit of FIG. 1 and showing part of that power unit.

FIG. 21 illustrates an attachment for grinding or polishing the surface of a concrete or terrazzo slab. This attachment includes a frame 268 having a pair of pins 269 axially aligned and positioned to be received in openings 53*a* and 55*a* of the power unit. The upper end of the frame forms an arm 270 having an opening to receive a belt tightener 271, of the type previously described. A pair of vertically aligned bearings 272 rotatably support a shaft 273. The shaft has limited vertical movement in the bearings. On the upper end of the shaft is a pulley or input wheel 274 which is driven by belt 275 from pulley 44 on engine 38. The lower end of the shaft carries a wheel 276 secured to which are grinding stones 277 of carborundum or the like.

Thus, if the contractor has a small area of terrazzo to finish, the attachment of FIG. 21 may be added to the power unit of FIG. 1. The engine 38 drives wheel 276 so that the stones 277 perform the grinding or polishing operation.

Figure 22:
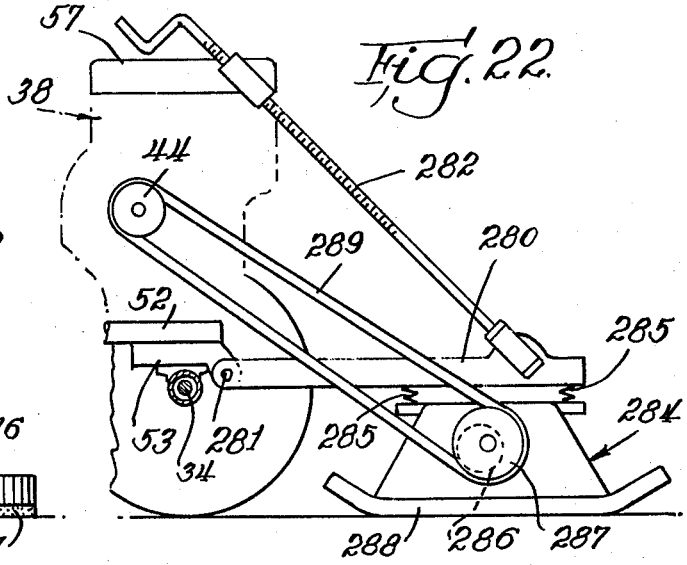
FIG. 22 is a vibrational compactor attachment for the power unit of FIG. 1 and showing part of that power unit.

FIG. 22 illustrates a compactor attachment. Quite often in pouring cement flatwork the specifications will require that the soil, sand, etc., on which the concrete flatwork is poured, be compacted before the concrete is poured. The attachment of FIG. 22 permits the concrete contractor to do this compaction job by the use of an attachment to the power unit of FIG. 1. In this embodiment there is a frame 280 having pins 281 positioned and aligned to be received in openings 53*a* and 55*a* of the power unit. The frame includes an opening by which the belt tightener 282 (of the type previously described) may be attached to the frame.

A vibrational compactor, generally 284, is suspended from frame 280 by springs 285. The compactor may be one of a number of conventional devices. In general, they employ a rotatable eccentric weight 286 driven by a pulley or input wheel 287. As the weight is rotated it produces a vibrational force which is applied to the material to be compacted by a shoe 288 forming a part of the compactor. Pulley 287 is connected to pulley 44 by a belt 289.

Figure 23:
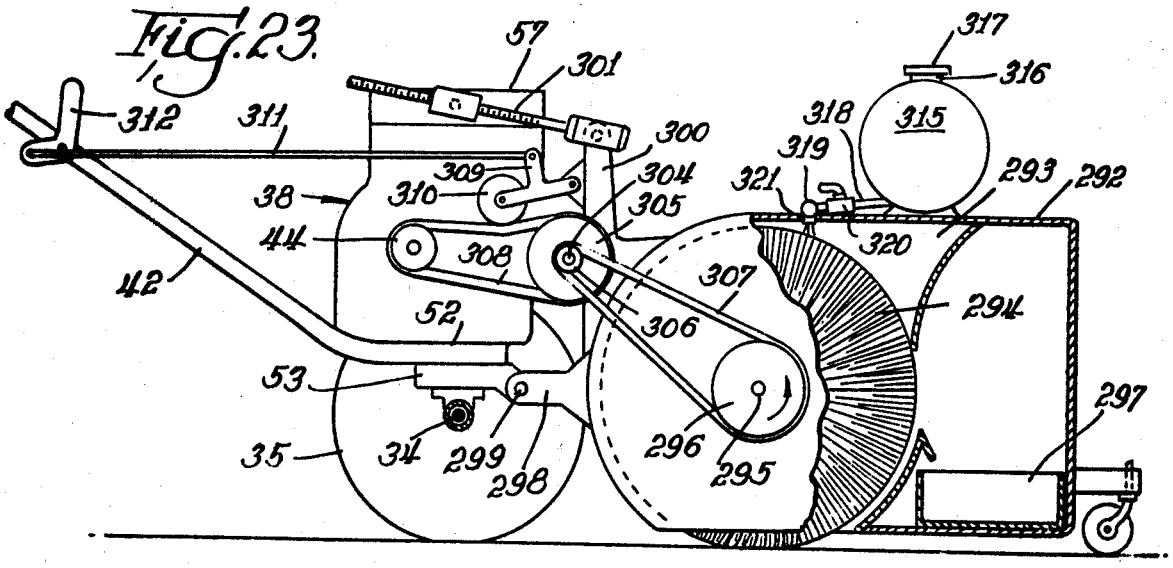
FIG. 23 is a side elevational view of a sweeper attachment, with portions broken away, mounted on the power unit of FIG. 1.

It is not uncommon for a concrete contractor to have the necessity of sweeping a relatively large area. For example, the specifications in a contract may require that the job is not complete until the concrete slab that the contractor has poured is "broom clean". This can be a time consuming labor job if performed by hand, and consequently expensive. Self-powered mechanical sweepers are available, but they are bulky to move from job to job. Also, they are expensive when not used with regularity. FIG. 23 illustrates a sweeping attachment usable with the power unit of FIG. 1.

In this embodiment there is a housing 292 which serves as the frame. The housing defines a closed chamber 293. Within this chamber is a rotatable brush 294. The brush is attached to and rotates with a shaft 295 journaled in the frame. Also attached to the shaft is a pulley or input wheel 296. Within chamber 293 is a container 297 to catch the sweepings. An access door not shown is provided in the side of the housing so that the container may be removed to be emptied. The housing or frame includes arms 298 having pins 299 thereon. These pins are, of course, aligned to be received in openings 53*a* and 55*a* of the power unit. An upwardly extending arm 300 has an opening in its upper end so that a belt tightener 301 is attachable thereto.

A shaft 304 is journaled on the attachment frame and carries speed reducing pulleys 305 and 306. A belt 307 connects pulleys 296 and 306. A belt 308 connects pulleys 305 and 44. A "T" shaped member 309 has one of its three ends pivotally mounted on arm 300. On a second of its three ends is a pulley 310 positioned to engage belt 308. On the third end, a rod 311 is pivotally attached. This rod is connected to a lever 312 pivotally mounted on handlebar 42. When the lever 312 is positioned as illustrated in FIG. 23, pulley 310 rides on belt 308 to tighten the belt and cause the brush to be driven. When lever 312 is rotated in a clockwise direction as viewed in FIG. 23, pulley 310 is raised from belt 308 so that the belt slips and the engine 38 no longer drives brush 294.

A water tank 315 is mounted on top of housing 292. It has a fill opening 316 covered by cap 317. A pipe 318 communicates with the bottom of tank 315 and with a manifold 319. A valve 320 in pipe 318 controls the flow of water from the tank to the manifold. Projecting from the bottom of the manifold are a plurality of spray heads 321. When valve 320 is open, water from tank 315 is sprayed onto the top of brush 294. This water reduces the amount of dust that the brush tends to stir up and discharge into the air as the sweeping is performed.

Figure 24:
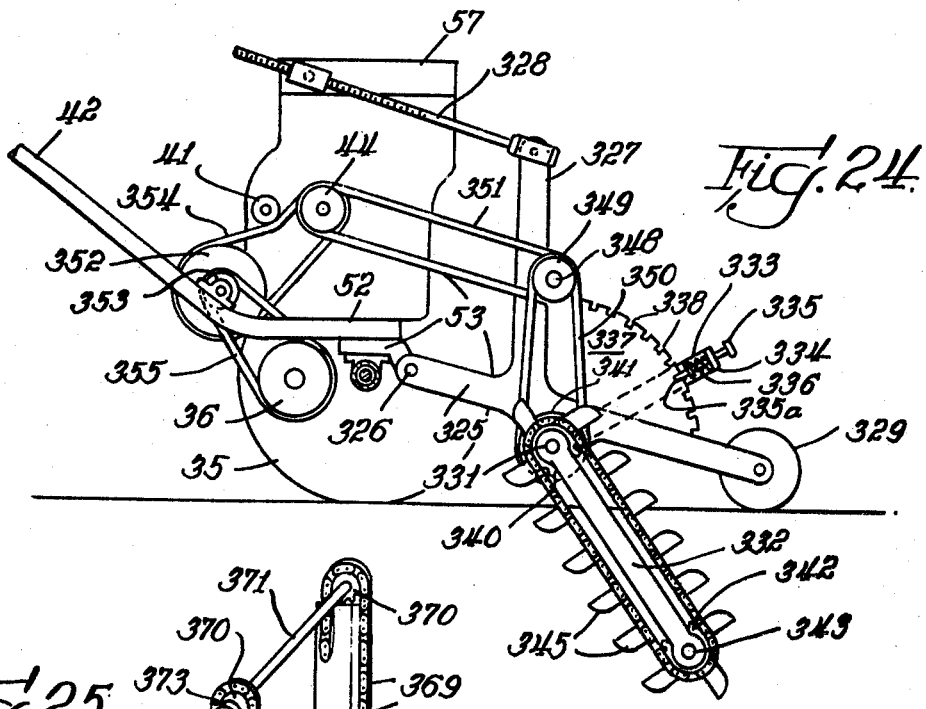
FIG. 24 is a trencher attachment mounted on the power unit of FIG. 1.

FIG. 24 illustrates a trencher attachment for the power unit of FIG. 1. For example, it is not uncommon for concrete foundations to be poured in the ground, using the ground at the sides of the trench for the forms for the concrete foundation. Other occasions will arise that make it necessary or desirable for the concrete contractor to have a power driven trencher. Again, however, the contractor may not need such an item of power equipment every day and it is advantageous for him to have an attachment to be added to the power unit for those occasions when a trencher is needed.

This attachment comprises a frame 325 having pins 326 positioned and aligned to be received in openings 53*a* and 55*a* of the power unit. The frame includes an arm 327 having an opening by which a belt tightener 328 is secured to the arm. The forward part of frame 325 carries a ground engaging wheel 329.

A shaft 331 is journaled on the bottom of frame 325. Secured to shaft 331 are a pair of spaced depending arms 332 and a third positioning arm 333. The positioning arm has a flange 334 at its distal end. A latch bolt 335 extends through flange 334 for longitudinal movement. A spring 336 urges the end 335*a* of the latch bolt away from flange 334. A segment 337 forming a part of frame 325 has a plurality of notches 338 to receive end 335*a*. By withdrawing latch bolt 335 against the resistance of spring 336 the positioning arm 333 may be moved about the segment and established in one of a variety of angular positions. This will, in turn, position shaft 331 and arms 332 at one of a variety of angular positions. This controls the depth of cut of the trencher.

Rotatably mounted on shaft 331 (between arms 332) are a sprocket 340 and a pulley 341. These are connected together for rotation in unison. A second sprocket 342 is rotatably mounted on a shaft 343 extending between arms 332. A chain 344 having a plurality of digging blades 345 extends between sprockets 340 and 342.

A shaft 348 is rotatably mounted on arm 327 and carries a pair of pulleys 349. One of pulleys 349 is connected by a belt 350 to pulley 341, the other pulley (or imput wheel) being connected by a belt 351 to pulley 44. Thus, engine 38 drives sprocket 340 which rotates the digging chain and blade.

A speed reducer is added to reduce the ground speed. This comprises idler pulleys 352 and 353. Pulley 352 is connected by a belt 354 to pulley 39 on the engine. Pulley 353 is connected by belt 355 to pulley 36 on the transaxle. Pulleys 352 and 353 are connected together for rotation in unison. Thus, engine pulley 39 continues to drive transaxle pulley 36, but at a reduced speed because of the stepped down effect from smaller to larger pulleys.

REINFORCING MESH LAYING ATTACHMENT OF FIGURE 25

This embodiment is an alternative to the embodiment of FIGS. 2–6. The attachment includes a "U" shaped frame including a pair of arms 359 and 360. The central part (not shown) of this "U" shaped frame is attached to the power unit as by means of a hitch such as that illustrated in FIG. 6. Pivotally mounted on the distal ends of the arms are a pair of posts 361 and 362. These posts are held upright by braces 363 and 364 detachably connected to the arm. Each arm has a ground engaging wheel 365 rotatably mounted on shaft 366.

Each of the posts has a "T" cross section with a hook 368 (defining a socket) slideably mounted on the forward face thereof (i.e., on what would be the top cross member of the "T"). Chains 369 extend about sprockets 370 and are secured to hooks 368. Each sprocket is secured to shaft 371. The end of the shaft forms a crank 372. The shaft is rotatable in bearings 373 on the top of the posts. A hook 374 is loosely attached to post 362 and serves to prevent the unwanted rotation of crank 372.

Figure 25:
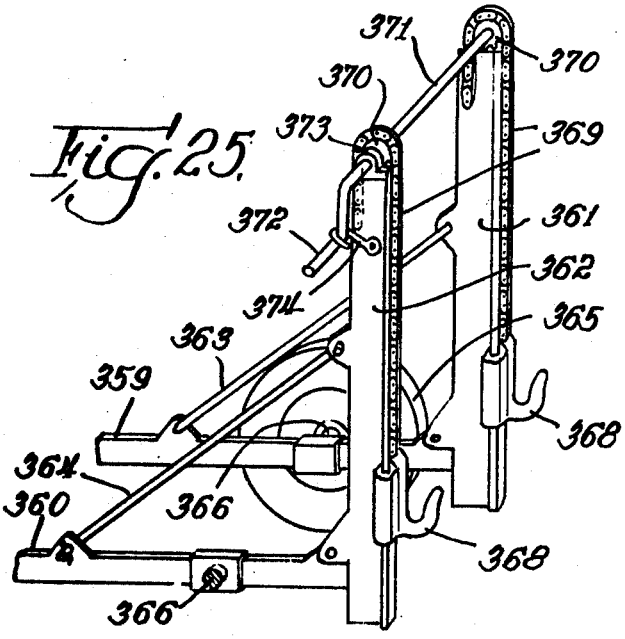
FIG. 25 is a perspective view of a portion of an alternative embodiment of reinforcing mesh laying attachment for the power unit of FIG. 1.

With the hooks 368 in a lowered position, the attachment is driven to a roll of mesh 105 having a trunnion or shaft 79 in the sockets defined by the hooks. The small end sections 78 of the shaft are placed in hooks 368. After loosening retainer 374, crank 372 is rotated (counterclockwise in FIG. 25) to raise hooks 368 and thus lift the roll 105 to an elevated position similar to the elevated position of roll 105 in FIG. 2. The end of the wire then is drawn off the roll and under wheels 35 of the power unit in the manner described in connection with the embodiment of FIGS. 2–6.

REINFORCING MESH LAYING DEVICE OF FIGURES 26–29

This reinforcing mesh laying device is one for use by those contractors whose work requires the laying of greater amounts of reinforcing. The apparatus is one on which the operator rides rather than walking behind it as was the case with the previously described embodiments. The power unit includes a frame 380 mounted on a transaxle 381. The transaxle drives shafts 382 on the ends of which are ground engaging wheels 383. The transaxle includes speed changing gears controlled by shift lever 384. A pulley 385 is mounted on the input shaft of the transaxle.

An internal combustion engine 387 is mounted on frame 380. A belt 388 connects the pulley on the output shaft of engine 387 to pulley 385 of the transaxle. Belt 388 also is contacted by an idler pulley 389 which serves as a clutch. A pivotally mounted lever 390 has pulley 389 mounted on one end thereof and a rod 391 connected to the other end. Lever 391 is actuated by a foot pedal 392. The arrangement is such that when the foot pedal is pressed down pulley 389 engages belt 388 so that the transaxle is driven from the engine. When the foot pedal is released pulley 389 moves away from belt 388, causing the belt to slip and the transaxle to no longer be driven. A seat 393 is provided for the operator and is suitably supported.

Figures 27, 28:
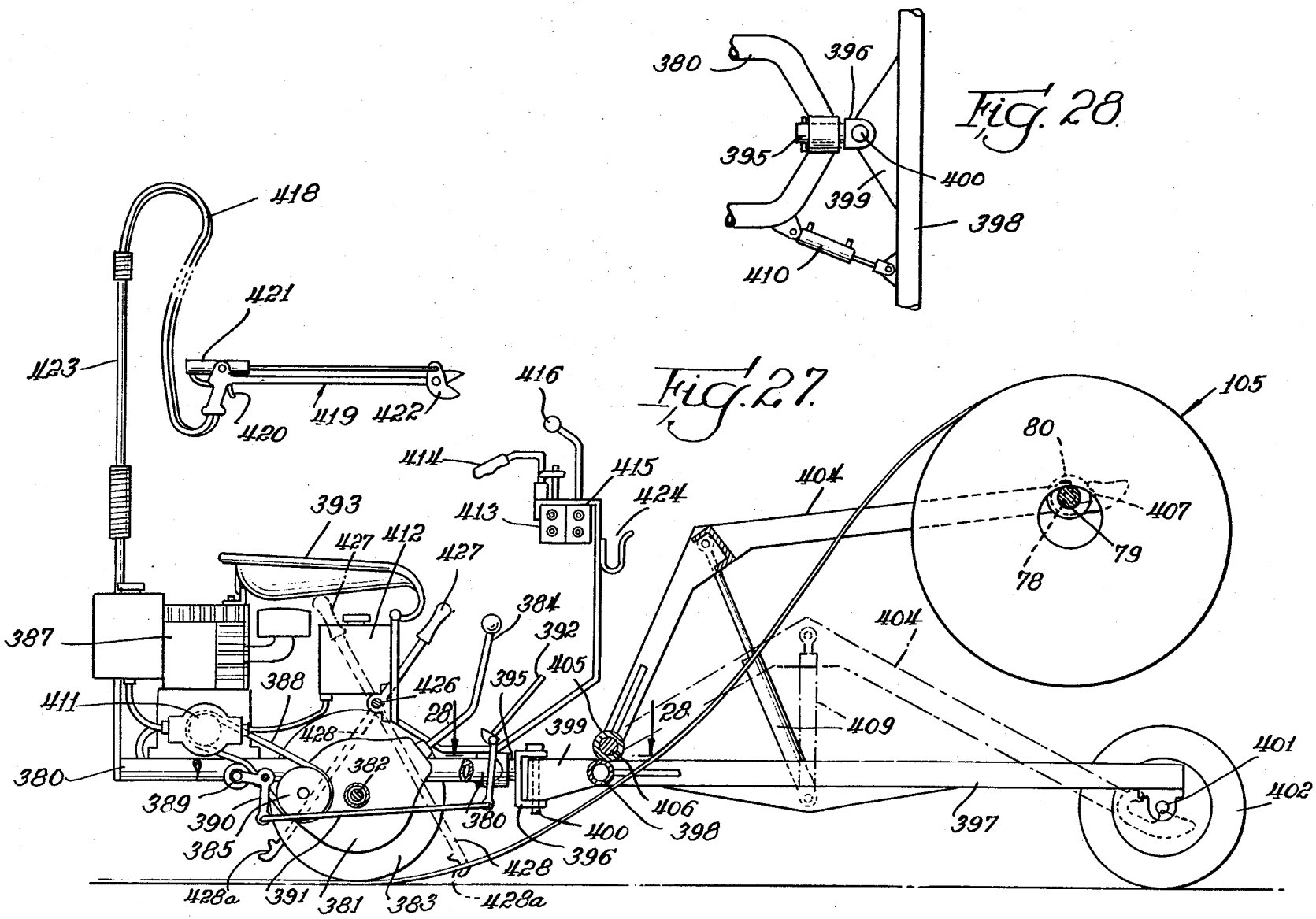
FIG. 27 is a side elevational view of a reinforcing mesh laying device in which the operator rides on the apparatus.
FIG. 28 is a fragmentary plan view illustrating the steering mechanism for the apparatus of FIG. 27.

The front of frame 380 is journaled to support a pin 395 (see particularly FIG. 28). Pin 395 is a unitary part of clevis 396. The attachment frame is generally "U" shaped comprising two arms 397 and a cross member 398. An extension 399 of cross member 398 is journaled to receive clevis pin 400. This connection of the two frames thus is in the form of a universal joint permitting movement of the "U" shaped frame about a vertical axis and a horizontal, front to rear, axis. The distal ends of the arms 397 carry axles 401 for rotatably supporting ground wheels 402.

The lifting arms 404 are welded to pipe 405. Stub shafts 406 are positioned above cross member 398 and welded thereto. These stub shafts extend into the ends of pipe 405 to pivotally support the pipe and arms 404. The distal ends of arms 404 have an opening 407, defining a socket, to receive the reduced size section 78 of mandrel or shaft 79.

Hydraulic lifting cylinders 409 interconnect arms 397 and 404. A hydraulic steering cylinder 410 interconnects power unit frame 380 and cross member 398 of the "U" shaped attachment frame. The hydraulic system also includes a pump 411 on the output shaft of engine 387 and a hydraulic fluid storage tank 412. The hydraulic control system includes a steering valve 413 actuated by steering lever 414 and a lifting valve 415 controlled by lever 416.

Also from the hydraulic system a hose 418 conducts hydraulic fluid to the hydraulically actuated wire clippers, generally 419. These clippers include a valve (not shown) operated by trigger 420. From that valve the oil is supplied to hydraulic cylinder 421 which powers the clippers 422. At the mounting end the hose 418 extends through a mast 423 which has a central spring section to permit the top of the mast substantial flexibility of movement with respect to the lower portion of the mast. On the dashboard of the apparatus are spring clips 424 to hold the wire clippers 419.

With the engine 387 running, the operator can drive the apparatus up to a roll 105 of mesh which is laying on the ground. By moving lever 414 the steering cylinder 410 is actuated so as to turn the front of the vehicle with respect to the rear, power unit section thereof. The arms 404 are lowered to the dot-dash position illustrated in FIG. 27 by the manipulation of lever 416. Assuming that the mandrel 79 is in the roll 105, the operator can drive the vehicle so that the openings 407 in the arms 404 are below the small section 78 of the mandrel 79. Lever 416 is then operated to extend hydraulic cylinders 409. Thus the roll can be raised to the position illustrated in full lines in FIG. 27. The exterior end of the mesh is then pulled down below the cross member 398 and to a position adjacent the front of wheels 383.

A shaft 426 is rotatably mounted on the power unit. It has a handle 427 secured thereto as well as two levers 428. Handle 427 is swung to the rear so that levers 428 extend forwardly. Then with the reinforcing mesh being down adjacent the front of wheels 383, handle 427 is moved forwardly so as to engage the bifurcated end **428*a* with a cross wire 107 of the mesh. While continuing to urge handle 427 forwardly, the operator drives the vehicle forwardly, the result being that the end of the mesh is inserted under the wheels 383** of the vehicle.

Figure 29:
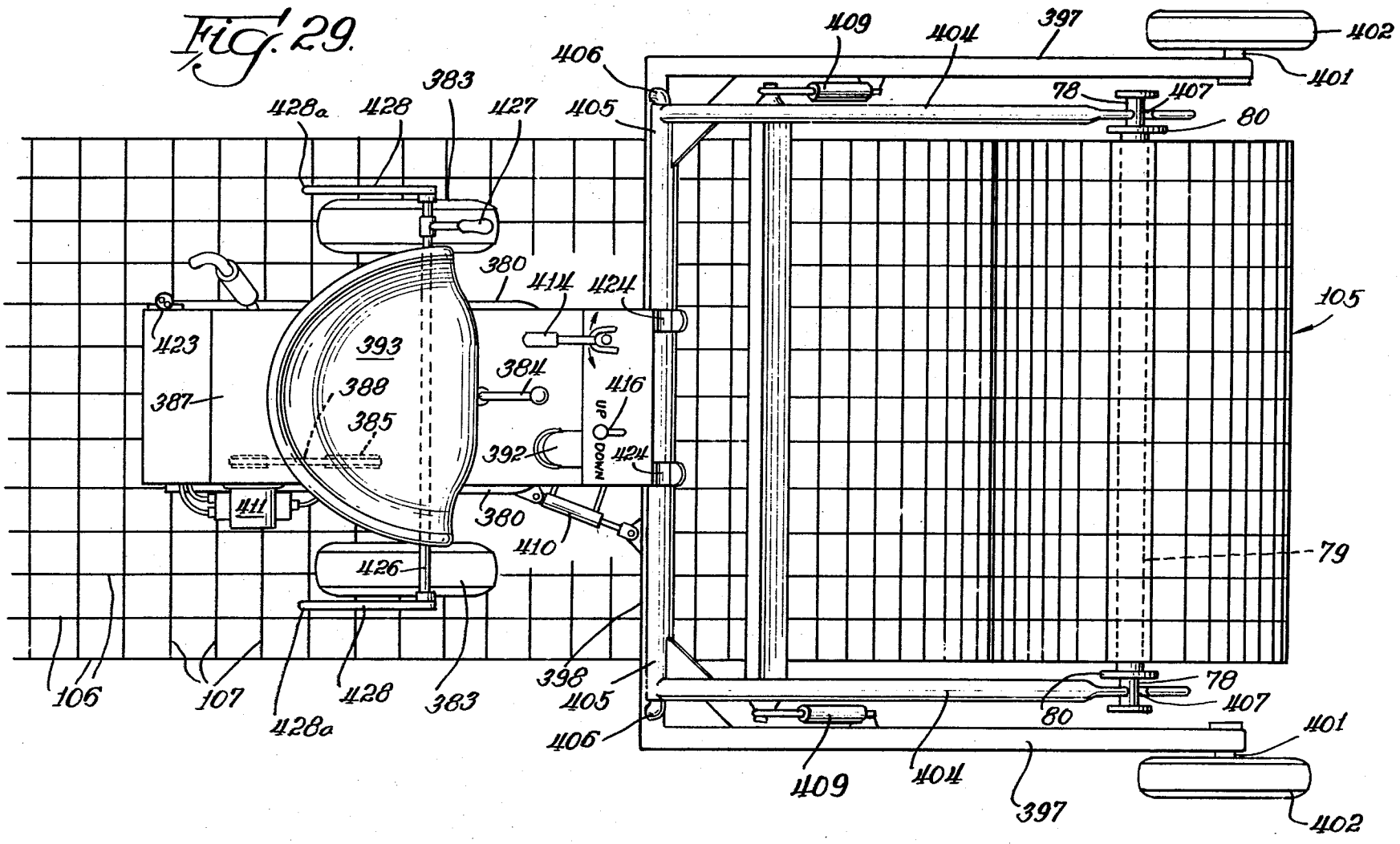
FIG. 29 is a plan view of the embodiment of FIG. 27.

The vehicle is now driven forwardly (to the right in FIGS. 27 and 29). As it does so, it drives over the mesh which is being unrolled from roll 105 and the mesh is laid on the ground or other supporting surface. In moving off of roll 105, passing under cross member 298 and proceeding under wheels 383 the mesh is backbended thereby making the longitudinal wires 106 of the mesh substantially straighter than would be the case were the mesh to be drawn directly off the roll without backbending.

Upon reaching the terminal point for the mesh being laid, the operator stops the vehicle. He then uses hydraulic clippers 419 to cut the longitudinal wires 106 to sever the mesh at the desired terminal point. Thereafter the vehicle is reoriented for laying the next strip of mesh. To start the laying of the next strip of mesh, the handle 427 is manipulated in the fashion previously described to insert the mesh again under the rear wheels 383.

Figure 26:
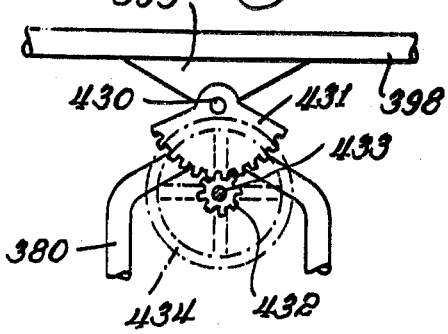
FIG. 26 is a view from the underside of a steering unit usable alternatively in the embodiment of FIG. 27.

In some instances a contractor may desire a riding unit similar to that of FIGS. 27 and 29, but without the hydraulic power. In that instance, a roll lifting mechanism similar to that illustrated and described in connection with FIGS. 2–5 or 25 could be mounted on "U" shaped frame 397, 398. For steering that "U" shaped frame with respect to the power unit frame 380, a steering mechanism such as that illustrated in FIG. 26 could be employed. In place of clevis pin 400, a shaft 430 would be used which extended below the bottom of the clevis. The shaft would be welded to extension 399, but rotatable in the clevis. On the bottom end of the shaft is a gear segment 431. This gear segment engages a pinion 432 on a shaft 433 rotatably mounted in frame 380. A steering wheel 434 could be secured to the upper end of shaft 433, or positioned at a remote location and operatively connected thereto. By turning steering wheel 434 the gear segment 431 would be rotated to change the position of the "U" shaped attachment frame with respect to the power unit frame 380.

We claim:

1. An apparatus for use by concrete contractors comprising:

a transaxle device having a power input, an axle housing, two ends and axles extending from each of said ends;

ground wheels respectively mounted on said axles;

a main frame including an engine and two generally horizontal supports, each support being between the central part of the housing and a respective end of the housing, said supports extending transversely to the housing and each having a first part extending to one side of said housing and a second part facing in the direction of the opposite side of said housing, said second part of said supports including an attachment mounting means, said supports being secured to the housing, said engine being mounted on said first parts of said supports;

drive means connecting said engine and said power input; and an attachment positioned at said opposite side of said housing and including a device connected to said mounting means.

2. An apparatus as set forth in claim 1 and for use in laying concrete reinforcing wire mesh from a roll having a given axial length, said apparatus comprising:

said wheels being spaced apart a distance less than said given length;

said attachment including means for moving said roll with respect to the ground while it is being unrolled.

3. An apparatus as set forth in claim 2, wherein said means of said attachment positions said roll so that the mesh unrolls from the top of the roll and passes under said wheels, whereby the mesh is backbended as it passes under the wheels.

4. An apparatus as set forth in claim 2, wherein said means of said attachment comprises:

a generally "U" shaped frame with its proximal end closed and its distal ends spaced apart a distance greater than said given length and projecting forwardly from the proximal end, ground engaging wheels mounted on said "U" frame adjacent the distal ends, and means connected to the "U" frame and positioned adjacent each of said distal ends for rotatably supporting said roll in the space above but generally between said distal ends.

5. An apparatus as set forth in claim 4, wherein said supporting means is movable in a generally vertical direction between a first position at which said roll is resting on the ground and a second position at which said roll is supported above the ground.

6. An apparatus as set forth in claim 5, wherein said supporting means comprises:

a pair of arms pivotally mounted on said "U" frame and spaced apart a distance greater than said given length, each arm having a distal end adjacent a respective one of the distal ends of the "U" frame, and trunnion means on the distal ends of said arms for rotatably supporting said roll.

7. An apparatus as set forth in claim 6, wherein said trunnion means comprises:

each of said distal ends including a socket having an opening in one side thereof, and a shaft resting in each of said sockets and extending between the arms, the portions of the shaft in the sockets being smaller than said openings whereby the shaft may be moved out of and into the sockets through said openings.

8. An apparatus as set forth in claim 7, wherein said device connected to said mounting means includes universal joint means for pivotal movement of the "U" frame with respect to the first mentioned frame about a vertical axis and also about a fore to aft aligned horizontal axis.

9. An apparatus as set forth in claim 8 including hydraulic power means connected to said engine to be driven thereby, linear hydraulic motor means connecting said first mentioned frame and said "U" frame for moving the "U" frame with respect to said first mentioned frame about said vertical axis, linear hydraulic motor means connecting said arms and said "U" frame for moving said arms with respect to said "U" frame, and hydraulic control means connecting said power means and said motor means.

10. An apparatus as set forth in claim 9, including hydraulic operated clipper means for cutting the wire of said mesh, and means connecting said clipper means to said hydraulic power means.

11. An apparatus as set forth in claim 8, wherein each of said arms is a lifting arm and is a part of a respective "L" shaped member having an operating arm, means attached at about the juncture of the two arms and attached to the "U" frame adjacent a respective distal end for pivotally mounting the member on the "U" frame to provide said pivotal mounting of the lifting arm, said member being pivotal between a first position at which the lifting arm is upright and the operating arm is generally horizontal and a second position at which the distal end of the lifting arm is substantially closer to the ground, including a cross member connecting the two operating arms.

12. An apparatus as set forth in claim 2, wherein said means for moving said roll comprises a pusher bar extending generally parallel to said axles and positioned adjacent the ground, said pusher bar being in front of said wheels.

13. An apparatus as set forth in claim 12, wherein said means for moving said roll includes an upright member extending from said pusher bar rearwardly and upwardly a distance greater than the diameter of the roll.

14. An apparatus as set forth in claim 13, wherein said bar is longer than said given length, and including plates at the ends of the bar respectively and extending forwardly from the ends of the bar for engaging the ends of the roll and guiding the roll.

15. An apparatus as set forth in claim 13, wherein said frame includes handlebar means extending out to the rear to enable a person walking on the ground at the rear to guide the apparatus, and including a hook extending downwardly from the frame rearwardly of the wheels and in front of the rear end of the handlebar means, the distal end of the hook pointing generally forwardly to catch the trailing end of the mesh when the roll is completely unrolled and preventing that trailing end from springing up against said person.

16. An apparatus as set forth in claim 13, wherein said frame includes handlebar means extending out to the rear to enable a person walking on the ground at the rear to guide the apparatus, and including means on said attachment for engaging upper and lower parts of said roll whereby with said means engaging said roll, the person may move said handle bar means downward and lift the roll off the ground for transportation by said apparatus.

17. An apparatus as set forth in claim 16, wherein said means for engaging said roll comprises a first arm pivotally mounted on the upper portion of said upright member, said arm having a first hook on the distal end thereof, said first hook pointing generally downward and to the rear when the first arm is generally horizontal, and a second arm pivotally mounted on the attachment, said second arm having its proximal end above and to the rear of said bar whereby it may be pivoted into a generally horizontal position at which it contacts said bar to prevent further downward movement thereof, said second arm having a second hook on the distal end thereof, said second hook pointing generally upwardly and to the rear when the second arm is in said generally horizontal position.

18. An apparatus as set forth in claim 1, wherein said frame includes handlebar means extending out to the rear to enable a person walking on the ground at the rear to guide the apparatus, and including a foot pivotally connected to said frame at the rear of said device, a manually movable operating member on said hadlebar means adjacent the rear thereof, and connecting means between said operating member and said foot, whereby by moving said operating member to one position said foot may be positioned generally downward to be in a position for engaging the ground and by moving the operating member to another position said foot may be raised from said downward position to permit the apparatus to be manipulated without interference from the foot, and whereby when the foot is in said downward position the weight of the engine will pivot the frame about the axle and press the foot against the ground so that the apparatus is stable.

19. An apparatus as set forth in claim 1, wherein said attachment mounting means comprises two attaching devices usable alternatively, one of said two devices and a first group of attachments used therewith having means for providing a pivotal connection between the attachments of said first group and the frame, and the other of said two devices and a second group of attachments used therewith having means for providing a rigid connection between the attachments of said second group and the frame.

20. An apparatus as set forth in claim 19, wherein said means for providing a rigid connection comprises:

a first pair of members with a first of said pair being a part of said main frame and the second of said pair being a part of the attachment of the second group;

a second pair of members with a first of said second pair being a part of said main frame and the second of said pair being a part of the attachment of the second group;

said pairs of members being spaced apart along a line parallel to the axle;

one member of each pair being a socket having a longitudinal axis and the other member of each pair being a shaft positioned in said socket, said longitudinal axis being positioned transverse to said line; and means releasably interconnecting the main frame and the attachment of the second group for preventing the shaft from being withdrawn from the socket; and said means for providing a pivotal connection comprises:

a third pair of members with a first thereof being a part of said main frame and a second thereof being a part of the attachment of said first group;

a fourth pair of members with a first thereof being a part of said main frame and a second thereof being a part of the attachment of the first group;

one member of each of said third and fourth pair defining a journal about a pivotal axis and the other member of said third and fourth pair defining a pivotal shaft positioned in the respective journal, said pivotal axis being parallel to said axle; and removable means for preventing said pivotal shaft from being withdrawn from the respective journal so long as said removable means is in place.

21. An apparatus as set forth in claim 20, wherein the attachment of the first group includes a rotatable member having a first pulley;

wherein the engine includes a power take-off pulley;

including a belt connecting said pulleys for driving the rotatable member from said engine; and wherein said attachment mounting means comprises means including a threaded rod on a nut interconnecting an upper part of the main frame and a part of the attachment of the first group which attachment part is spaced from said pivotal connection, whereby by rotating said rod the attachment of the first group is pivoted with respect to the main frame thereby adjusting the tension on said belt.

22. An apparatus as set forth in claim 21, wherein said first group of attachments comprises:

concrete saw means for sawing a concrete slab from the top thereof;

air compressor means;

electric generator means;

fluid pump means;

concrete grinding means for grinding the top surface of a concrete slab;

vibrating compaction means;

sweeper means; and trencher means.

23. An apparatus as set forth in claim 21, wherein said frame includes handlebar means extending out to said one side whereby a person walking on the ground can guide said apparatus toward him, said first group of attachments includes concrete saw means attachment for sawing a concrete slab from the top thereof, said saw means attachment comprising:

a saw blade;

a mandrel positioned at said opposite side of the housing, said first pulley being on said mandrel, said mandrel having means for holding the saw blade at a given longitudinal location on the mandrel;

a support positioned at said one side of the housing;

guide means on said support and positioned in said path in advance of the saw blade; and means connecting the mandrel and the main frame for raising and lowering the mandrel.

24. An apparatus as set forth in claim 20, wherein said second group of attachments comprises:

means for laying concrete reinforcing wire mesh.

25. An apparatus as set forth in claim 1, wherein said frame includes handlebar means extending out to said one side whereby a person walking on the ground can guide said apparatus toward him, said attachment comprising concrete saw means for sawing a concrete slab from the top thereof and comprising:

a saw blade;

a mandrel positioned at said opposite side of the housing, said mandrel having means for holding the saw blade at a given longitudinal location on the mandrel;

a guide support positioned at said one side of the housing; and guide means on said support and positioned in said path in advance of the saw blade.

26. An apparatus as set forth in claim 25, wherein said guide support is mounted for pivotal movement with respect to said main frame about an axis, said guide support including means for contacting the ground; and including means connecting said frame and the guide support for selectively setting the position of the guide support with respect to the main frame;

whereby with said means of said guide support resting on the ground, the positional setting of the guide support with respect to the frame will determine the depth of cut of the saw blade.

27. An apparatus as set forth in claim 26, wherein said device includes a pivotal connection for pivotal movement of the attachment about an axis generally parallel to said axles;

including a pulley on the mandrel, a pulley on the engine and belt drive means extending between said pulleys for driving the saw blade from the engine; and including means interconnecting the mandrel and the main frame for adjusting the pivotal position of the mandrel about the last mentioned axis thereby adjusting the tension on said belt drive means.

28. An apparatus as set forth in claim 1, wherein said attachment is an air compressor having an input wheel, and including drive means interconnecting said input wheel and said engine.

29. An apparatus as set forth in claim 1, wherein said attachment is an electric generator having an input wheel, and including drive means interconnecting said input wheel and said engine.

30. An apparatus as set forth in claim 1, wherein said attachment is a water pump having an input wheel, and including drive means interconnecting said input wheel and said engine.

31. An apparatus as set forth in claim 1, wherein said attachment is a winch having an input wheel, and including drive means interconnecting said input wheel and said engine.

32. An apparatus as set forth in claim 1, wherein said attachment is a surface grinder having an input wheel, and including drive means interconnecting said input wheel and said engine.

33. An apparatus as set forth in claim 1, wherein said attachment is a vibrating compactor having an input wheel, and including drive means interconnecting said input wheel and said engine.

34. An apparatus as set forth in claim 1, wherein said attachment is a rotary sweeper having an input wheel, and including drive means interconnecting said input wheel and said engine.

35. An apparatus as set forth in claim 1, wherein said attachment is a trencher having an input wheel, and including drive means interconnecting said input wheel and said engine.

36. In an apparatus for use by concrete contractors for laying concrete reinforcing wire mesh from a roll having an axis, said apparatus comprising a vehicle having a front end and a rear end, wheel means for movably supporting the frame for movement in a rear to front direction, an engine, drive means connecting the engine and the wheel means for driving the wheel means from the engine, and means adjacent one of said ends for positioning the roll axis transverse to said direction and permitting the roll to unroll as the vehicle moves, the improvement wherein said positioning means comprises:

a generally "U" shaped frame with its proximal end closed and its distal ends spaced apart a distance greater than said given length and projecting forwardly from the proximal end, and front wheel means comprising ground engaging wheels mounted on said "U" frame adjacent the distal ends, said means for positioning said roll being connected to the "U" frame and positioned adjacent each of said distal ends for rotatably supporting said roll in the space above but generally between said distal ends.

37. In an apparatus as set forth in claim 36, wherein said supporting means is movable in a generally vertical direction between a first position at which said roll is resting on the ground and a second position at which said roll is supported above the ground.

38. In an apparatus as set forth in claim 37, wherein said supporting means comprises:

a pair of arms pivotally mounted on said "U" frame and spaced apart a distance greater than said given length, each arm having a distal end adjacent a respective one of the distal ends of the "U" frame, and trunnion means on the distal ends of said arms for rotatably supporting said roll.

39. In an apparatus as set forth in claim 38, wherein said trunnion means comprises:

each of said distal ends including a socket having an opening in one side thereof, and a shaft resting in each of said sockets and extending between the arms, the portions of the shaft in the sockets being smaller than said openings whereby the shaft may be moved out of and into the sockets through said openings.

40. In an apparatus as set forth in claim 39, wherein said device connected to said mounting means includes universal joint means for pivotal movement of the "U" frame with respect to the first mentioned frame about a vertical axis and also about a fore to aft aligned horizontal axis.

41. In an apparatus as set forth in claim 40 including hydraulic power means connected to said engine to be driven thereby, linear hydraulic motor means connecting said first mentioned frame and said "U" frame for moving the "U" frame with respect to said first mentioned frame about said vertical axis, linear hydraulic motor means connecting said arms and said "U" frame for moving said arms with respect to said "U" frame, and hydraulic control means connecting said power means and said motor means.

42. In an apparatus as set forth in claim 40, wherein each of said arms is a lifting arm and is a part of a respective "L" shaped member having an operating arm, means attached at about the juncture of the two arms and attached to the "U" frame adjacent a respective distal end for pivotally mounting the member on the "U" frame to provide said pivotal mounting of the lifting arm, said member being pivotal between a first position at which the lifting arm is upright and the operating arm is generally horizontal and a second position at which the distal end of the lifting arm is substantially closer to the ground, including a cross member connecting the two operating arms.

43. In an apparatus as set forth in claim 38 including hydraulic power means connected to said engine to be driven thereby, linear hydraulic motor means connecting said first mentioned frame and said "U" frame for moving the "U" frame with respect to said first mentioned frame about said vertical axis, linear hydraulic motor means connecting said arms and said "U" frame for moving said arms with respect to said "U" frame, and hydraulic control means connecting said power means and said motor means.

44. In an apparatus as set forth in claim 43, including hydraulic operated clipper means for cutting the wire of said mesh, and means connecting said clipper means to said hydraulic power means.

45. In an apparatus as set forth in claim 36, wherein said device connected to said mounting means includes universal joint means for pivotal movement of the "U" frame with respect to the first mentioned frame about a vertical axis and also about a fore to aft aligned horizontal axis.

46. An apparatus for use by a workman to lay concrete reinforcing wire mesh onto a supporting surface from a roll having an axis, said apparatus comprising:

a vehicle having a front and a rear, said vehicle including a frame, wheels on opposite sides of the vehicle for movably supporting the frame, an engine and drive means connecting the engine and the wheels for driving the wheels from the engine;

handlebar means projecting rearwardly from the frame in a position to be grasped by the workman and manipulated to position the vehicle;

means at the front of the vehicle for positioning said roll axis transversely to the front to rear direction of the vehicle and permitting the roll to unroll ahead of the vehicle as it moves forwardly, said positioning means comprising a pusher bar extending transversely to the front to back direction, in front of said wheels and about the level of said surface;

whereby the workman can bring the pusher bar up against a roll resting on the supporting surface and cause the roll to roll along said surface while manipulating the handlebar means to cause the pusher bar to contact a selected part of the roll and thus direct the roll.

47. An apparatus as set forth in claim 46, wherein the positioning means includes an upright member extending from intermediate the ends of said pusher bar rearwardly and upwardly a distance greater than the diameter of the roll.

48. An apparatus as set forth in claim 47, wherein said bar is longer than said given length, and including plates at the ends of the bar respectively and extending forwardly from the ends of the bar for engaging the ends of the roll and guiding the roll.

49. An apparatus as set forth in claim 47, including means on said frame for engaging upper and lower parts of said roll whereby with said means engaging said roll, the person may move said handlebar means downward and lift the roll off the ground for transportation by said apparatus.

50. An apparatus as set forth in claim 49, wherein said means for engaging said roll comprises a first arm pivotally mounted on the upper portion of said upright member, said arm having a first hook on the distal end thereof, said first hook pointing generally downward and to the rear when the first arm is generally horizontal, and a second arm pivotally mounted on the attachment, said second arm having its proximal end above and to the rear of said bar whereby it may be pivoted into a generally horizontal position at which it contacts said bar to prevent further downward movement thereof, said second arm having a second hook on the distal end thereof, said second hook pointing generally upwardly and to the rear when the second arm is in said generally horizontal position.

51. An apparatus as set forth in claim 46, including a hook extending downwardly from the frame rearwardly of the wheels and in front of the rear end of the handlebar means, the distal end of the hook pointing generally forwardly to catch the trailing end of the mesh when the roll is completely unrolled and preventing that trailing end from springing up against said person.

52. In an apparatus for use in cutting into the surface of a concrete slab and comprising a vehicle having a front and a rear, said vehicle including a main frame, a pair of drive wheels mounted on coaxial axles, an engine, first drive means connecting the engine and the drive wheels for moving the apparatus toward the front, a mandrel, a device connecting the mandrel to the main frame, a saw blade mounted on the mandrel, second drive means connecting the engine and the mandrel for driving the saw blade, and handlebar means to enable a workman to direct the movement of the vehicle, the improvement comprising:

said mandrel being positioned to the rear of said wheels;

a guide support positioned to the front of said wheels; and guide means on said support and positioned in the front of said wheel means in alignment with the saw blade.

53. In an apparatus as set forth in claim 52, wherein said guide support is mounted tor pivotal movement with respect to said main frame about an axis, said guide support including means for contacting the ground; and including means connecting said main frame and the guide support for selectively setting the position of the guide support with respect to the main frame;

whereby with said means of said guide support resting on the ground, the positional setting of the guide support with respect to the frame will determine the depth of cut of the saw blade.

54. An apparatus as set forth in claim 53, wherein said device includes a pivotal connection for pivotal movement of the mandrel about an axis generally parallel to said axles;

including a pulley on the mandrel, a pulley on the engine and belt drive means extending between said pulleys for driving the saw blade from the engine; and including means interconnecting the mandrel and the main frame for adjusting the pivotal position of the mandrel about the last mentioned axis thereby adjusting the tension on said belt drive means.

55. In an apparatus as set forth in claim 52, wherein said handlebar means entends forwardly to the front of said wheels, and said engine and said second drive means rotate said saw blade in a direction such that the bottom of the blade is moving toward the rear.

56. An apparatus as set forth in claim 52, wherein said device includes a pivotal connection for pivotal movement of the mandrel about an axis generally parallel to said axles;

including a pulley on the mandrel, a pulley on the engine and belt drive means extending between said pulleys for driving the saw blade fron the engine; and including means interconnecting the mandrel and the main frame for adjusting the pivotal position of the mandrel about the last mentioned axis thereby adjusting the tension on said belt drive means.

* * * * *

UNITED STATES PATENT AND TRADEMARK OFFICE

CERTIFICATE OF CORRECTION

PATENT NO. : 4,077,731

DATED : March 7, 1978

INVENTOR(S) : Orville H. Holz, Sr. and Norbert J. Holz

Figure 11:
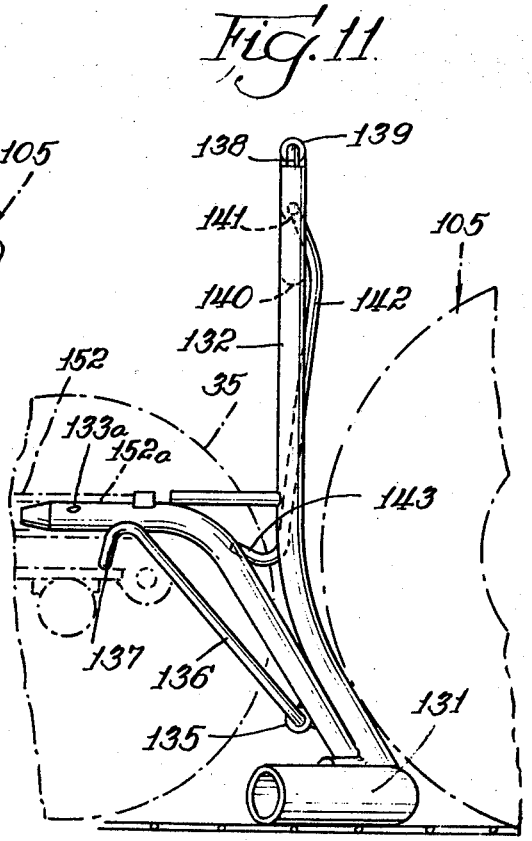
FIG. 11 is a side elevational view of the attachment of FIG. 9 when used in the laying of the mesh from the roll.

It is certified that error appears in the above-identified patent and that said Letters Patent are hereby corrected as shown below:

| | |
|---|---|
| Col. 6, l. 41 | "ae" should be --are-- |
| Col. 6, l. 63 | before clutch "a" should be --the-- |
| Col. 7, l. 4 | insert "of" before "force" |
| Col. 7, l. 15 | after "out" "of" should be --to-- |
| Col. 8, l. 17 | change "of" to --in-- before "FIG. 11" |
| Col. 8, l. 23 | after "frame" "of" should be --for-- |
| Col. 8, l. 37 | before "block" "the" should be --a-- |
| Col. 8, l. 54 | delete "a" before "sleeve" |
| Col. 8, l. 63 | after "engine" "pulley" should be --pulleys-- |
| Col. 10, l. 20 | "purpose" should be --purposes-- |
| Col. 18, l. 20 | "hadlebar" should be --handlebar-- |
| Col. 24, l. 39 | "fron" should be --from-- |

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*